US009989344B2

(12) United States Patent
Zank et al.

(10) Patent No.: US 9,989,344 B2
(45) Date of Patent: Jun. 5, 2018

(54) METHOD OF PRODUCING AN EXPLOSIVE EMULSION COMPOSITION

(71) Applicant: Orica International Pte Ltd, Singapore (SG)

(72) Inventors: Johann Zank, Valentine (AU); Mark Stuart Rayson, Tuggerawong (AU); Vladimir Sujansky, East Burwood (AU); James Walter, Cottesloe (AU); Ian John Kirby, Ayr (GB); John Cooper, Ayr (GB)

(73) Assignee: ORICA INTERNATIONAL PTE LTD, Singapore (SG)

( * ) Notice: Subject to any disclaimer, the term of this patent is extended or adjusted under 35 U.S.C. 154(b) by 0 days. days.

(21) Appl. No.: 14/900,120

(22) PCT Filed: Jun. 20, 2014

(86) PCT No.: PCT/AU2014/050088
§ 371 (c)(1),
(2) Date: Dec. 18, 2015

(87) PCT Pub. No.: WO2014/201526
PCT Pub. Date: Dec. 24, 2014

(65) Prior Publication Data

US 2016/0145165 A1 May 26, 2016

(30) Foreign Application Priority Data

Jun. 20, 2013 (SG) ..... 2013048376

(51) Int. Cl.
*F42D 1/10* (2006.01)
*F42D 3/04* (2006.01)
(Continued)

(52) U.S. Cl.
CPC ..... *F42D 1/10* (2013.01); *C06B 21/0008* (2013.01); *C06B 23/003* (2013.01); *C06B 23/004* (2013.01); *F42D 3/04* (2013.01)

(58) Field of Classification Search
CPC ..... F42D 1/00; F42D 1/08; F42D 1/10; F42D 3/00; F42D 3/04; F42D 3/06;
(Continued)

(56) References Cited

U.S. PATENT DOCUMENTS 3,774,496 A 11/1973 Roach
3,797,392 A 3/1974 Eckels
(Continued)

FOREIGN PATENT DOCUMENTS

CN 103193557 7/2013
EP 0136081 B1 11/1987
(Continued)

OTHER PUBLICATIONS

Supplementary European Search Report for European Application No. 14813070.1, dated Jan. 26, 2017, 27 pages.
(Continued)

*Primary Examiner* — James S Bergin

(57) ABSTRACT

A method of producing an explosive composition comprising a liquid energetic material and sensitizing voids, the sensitizing voids being present in the liquid energetic material with a non-random distribution, which method comprises: providing a flow of liquid energetic material; and delivering sensitizing voids into the flow of liquid energetic material in a series of pulses to provide regions in the liquid energetic material in which sensitizing voids are sufficiently concentrated to render those regions detonable and regions in the liquid energetic material in which the sensitizing voids are not so concentrated.

19 Claims, 19 Drawing Sheets

(51) Int. Cl.
*C06B 23/00* (2006.01)
*C06B 21/00* (2006.01)

(58) Field of Classification Search
CPC ... C06B 23/002; C06B 23/003; C06B 23/004; C06B 21/0008
USPC ..... 102/313
See application file for complete search history.

(56) References Cited

U.S. PATENT DOCUMENTS

| | | | |
|---|---|---|---|
| 4,104,092 | A | 8/1978 | Mullay |
| 4,326,900 | A | 4/1982 | Hattori et al. |
| 4,554,032 | A | 11/1985 | Hattori et al. |
| 4,614,146 | A | 9/1986 | Ross et al. |
| 4,757,764 | A | 7/1988 | Thureson et al. |
| 5,099,763 | A | 3/1992 | Coursen et al. |
| 5,470,407 | A | 11/1995 | Griffith et al. |
| 5,524,523 | A | 6/1996 | Lëbbe et al. |
| 5,584,222 | A | 12/1996 | Engsbråten et al. |
| 5,712,440 | A | 1/1998 | Eagar et al. |
| 5,783,768 | A | 7/1998 | Jacobson |
| 6,125,761 | A | 10/2000 | Smith, Jr. et al. |
| 6,165,297 | A | 12/2000 | Smith et al. |
| 6,173,662 | B1 | 1/2001 | Donovan |
| 6,397,719 | B1 | 6/2002 | Vestre |
| 6,537,399 | B2 | 3/2003 | Gomez De Segura et al. |
| 6,669,753 | B1 | 12/2003 | Chambers et al. |
| 6,877,432 | B2 | 4/2005 | Thomson et al. |
| 6,982,015 | B2 | 1/2006 | Atkinson et al. |
| 7,370,565 | B2 | 5/2008 | Pressley et al. |
| 7,971,534 | B2 | 7/2011 | Waldock |
| 8,230,937 | B1 | 7/2012 | Asay et al. |
| 8,708,202 | B2 | 4/2014 | Robertson et al. |
| 8,820,242 | B2 | 9/2014 | Alexander |
| 9,175,933 | B2 | 11/2015 | Patel |
| 9,207,055 | B2 * | 12/2015 | Halander ..... F42D 3/04 |
| 9,267,777 | B2 * | 2/2016 | Waldock ..... F42D 1/10 |
| 9,415,360 | B2 * | 8/2016 | Xue ..... F42D 1/10 |
| 9,435,625 | B2 * | 9/2016 | Halander ..... F42D 3/04 |
| 2003/0006319 | A1 | 1/2003 | Silverstein et al. |
| 2003/0029346 | A1 | 2/2003 | Atkinson et al. |
| 2014/0352567 | A1 | 12/2014 | Cooper et al. |
| 2015/0218061 | A1 | 8/2015 | Cooper et al. |
| 2016/0146587 | A1 | 5/2016 | Zank et al. |

FOREIGN PATENT DOCUMENTS

| | | | |
|---|---|---|---|
| EP | 0142271 | B1 | 2/1988 |
| EP | 1571136 | A2 | 9/2005 |
| GB | 2218701 | A | 11/1989 |
| GB | 2338429 | A | 12/1999 |
| NL | 6918158 | A | 6/1971 |
| WO | WO 97/24298 | A1 | 7/1997 |
| WO | WO 97/30955 | A1 | 8/1997 |
| WO | WO 2002/024608 | A1 | 3/2002 |
| WO | WO 2009/092137 | | 7/2009 |
| WO | WO 2013/086572 | | 6/2013 |

OTHER PUBLICATIONS

International Search Report and Written Opinion for International Application No. PCT/AU2014/050088, dated Aug. 11, 2014, 9 pages.

* cited by examiner

METHOD OF PRODUCING AN EXPLOSIVE EMULSION COMPOSITION

CROSS-REFERENCES TO RELATED APPLICATIONS

This application is a U.S. national phase application of International PCT Patent Application No. PCT/AU2014/050088, which was filed on Jun. 20, 2014, which claims priority to Singapore Patent Application No. 2013048376, filed Jun. 20, 2013. These applications are incorporated herein by reference in their entireties.

TECHNICAL FIELD

The present invention relates to the manufacture of explosive compositions, in particular emulsion explosive compositions that are tailored to provide desired blasting properties. The present invention also relates to the integration of such manufacture in a blasting operation in which the explosive composition that is manufactured is provided in a blasthole.

BACKGROUND

Detonation energy of commercial explosives can be broadly divided into two forms—shock energy and heave energy. Shock energy fractures and fragments rock. Heave energy moves blasted rock after fracture and fragmentation. In general the higher the velocity of detonation (VOD) of an explosive the higher proportion of shock energy the explosive is likely to exhibit.

Certain mining applications require the use of explosives that exhibit a combination of low shock energy and high heave energy. This allows fragmentation to be controlled (high shock energy produces significant amounts of dust sized fines) and in turn reduces excavation costs. In softer rock and coal mining applications, for example, the use of explosives that provide a relatively high proportion of heave energy can lead to significant savings downstream for the mine operation because collection of blasted rock then becomes easier. In quarry applications, fragmentation control and reduction of fines is also very attractive.

Current commercial explosives offer a range of shock and heave energies. For example, ANFO (ammonium nitrate/fuel oil) tends to provide a particular balance between shock and heave energies (low shock energy and high heave energy), and is frequently used as a reference point for assessing blast performance. In fact, ANFO with all of its ammonium nitrate present as prill exhibits what is conventionally believed to be an excellent combination of shock (fragmentation) and heave properties for many rock blasting and collection situations.

In contrast, homogeneous fluid explosive compositions, such as ammonium nitrate emulsion explosives tend to provide high shock energy and low heave energy. It is well known that such emulsion explosives tend to have relatively high velocities of detonation and correspondingly high pressure in the chemical reaction zone. This results in a high shock explosive that is well suited to fragmenting rock, but that has relatively low heave energy to move fragmented rock. Various water gel explosives provide a similar range of performance to emulsion explosives.

In practice, materials that modify explosive characteristics, such as ammonium nitrate (AN) prill are conventionally added to emulsion explosives to enhance their overall heave properties. Prills are understood to contribute to a late burn in the post detonation zone and this manifests itself as heave energy rather than shock energy.

The explosive properties of prill-containing explosive compositions are closely related to the explosive characteristics of the prill itself and, in turn, the explosive characteristics are influenced by factors including the physical features, internal structures and chemical composition of the prill. However, such factors may vary within a wide range depending on such things as the manufacturing technology used to produce the prill, the type and/or content of additives (and/or contaminants) present in the prill, the manner in which the prill is stored and/or transported, and the context of use of the explosive, including the degree of confinement and environmental factors, such as temperature and humidity. As a result, the detonation performance (including the energy release characteristics) of conventional prill-containing explosives tends to be highly variable. Explosive formulations with a high concentration of prill are also very difficult to pump into a blasthole. In contrast, emulsion explosives and slurry formulations are readily pumped and particularly useful in wet conditions. ANFO based formulations can only be used in wet conditions after dewatering of the boreholes.

A further consideration in relation to the use of ANFO and AN prill-containing emulsion explosives is the cost of manufacture of AN prill. AN prill manufacturing towers represent a significant fraction of capital expenditure associated with an ammonium nitrate production facility. Prilling is also a highly energy intensive process that adds significantly to the carbon footprint associated with these type of explosives.

Against this background, the Applicant has devised an explosive for commercial blasting operations that does not require the use of ammonium nitrate prill and that therefore does not suffer the potential problems associated with the use of prill, but that can achieve at least comparable rock blasting performance as currently used ANFO and AN prill-containing explosives. The explosive composition devised by the Applicant exhibits the desirable features of conventional ANFO and AN prill-containing explosives in terms of detonation energy ratio as between shock and heave energies, but that is free of the practical (and economic) constraints associated with the use of such prill-containing conventional explosives.

More specifically, the Applicant has devised an explosive composition comprising a liquid energetic material and sensitizing voids, wherein the sensitizing voids are present in the liquid energetic material with a non-random distribution, and wherein the liquid energetic material comprises (a) regions in which the sensitizing voids are sufficiently concentrated to render those regions detonable and (b) regions in which the sensitizing voids are not so concentrated. The explosive composition is therefore defined with reference to its internal structure. Explosive compositions that have this particular internal structure/void distribution exhibit desirable features of conventional ANFO and AN prill-containing explosives in terms of detonation energy ratio as between shock and heave energies, but that is free of the practical (and economic) constraints associated with the use of such prill-containing conventional explosives. For ease of reference the explosive compositions that may be produced in accordance with the present invention are referred to in general terms as having a non-random distribution of sensitizing voids in a liquid energetic material. Such explosive compositions are described in the Applicant's International patent application nos. PCT/AU2012/001527 and PCT/AU2012/001528, the contents of which are incorporated herein by reference. The invention may have particular applicability to such explosive compositions. The contents of the Applicant's International patent application nos. PCT/AU2012/001527 and PCT/AU2012/001528 are set out in detail.

Moreover, with explosive compositions that have a non-random void distribution, blast performance/characteristics can be adjusted in order to suit an array of different blasting requirements. For example, it may be desired to vary explosive performance across a blast field by loading individual blastholes with an explosive formulation that is most well suited to the characteristics of each blasthole, the prevailing geological conditions and/or the intended blast outcome. Conventional blasting practice has generally been to deliver the same explosive formulation to each blasthole in a blast field irrespective of blasthole characteristics etc. This approach can yield acceptable results but there is scope for improvement by designing or matching the explosive formulation used on a hole-by-hole basis. However, this brings with it certain practical challenges, not least how to undertake formulation manufacture, formulation variation and blasthole loading in a manner that is convenient and economical to implement. The present invention seeks to provide solutions that meet these practical challenges.

SUMMARY OF THE INVENTION

In an embodiment, the present invention provides a method of producing an explosive composition comprising a liquid energetic material and sensitizing voids, the sensitizing voids being present in the liquid energetic material with a non-random distribution, which method comprises:

providing a flow of liquid energetic material; and delivering sensitizing voids into the flow of liquid energetic material in a series of pulses to provide regions in the liquid energetic material in which sensitizing voids are sufficiently concentrated to render those regions detonable. It will be appreciated that there will also be other regions in the liquid energetic material in which the sensitizing voids are less concentrated or absent, rendering different detonation properties in these regions.

The present invention also provides a method of blasting which comprises providing in a blasthole an explosive composition comprising a liquid energetic material and sensitizing voids, the sensitizing voids being present in the liquid energetic material with a non-random distribution, wherein the explosive composition has been produced in accordance with the method of the invention, and detonating the explosive composition In another embodiment, the present invention provides a mobile manufacturing and delivery platform (MMDP) that is adapted to provide in a blasthole an explosive composition in accordance with the method of the invention.

In an embodiment, the present invention also provides a portable module (PM) that is adapted to provide in a blasthole an explosive composition in accordance with the method of the invention. The PM will include the necessary componentry to undertake manufacturing and delivery of explosive compositions as required in the context of the invention.

In an embodiment of the invention, the manufacturing methodology employed in the MMDP and PM is suitably flexible so that the characteristics of the explosive composition (e.g. the distribution and/or the concentration of voids), and thus the blasting performance, can be varied with ease so that tailored blasting solutions can be provided between different blastholes in a blastfield.

The componentry required in the MMDP and PM and the working inter-relationship of componentry will become apparent as the invention is explained in greater detail. In general terms the MMDP and PM will typically include a system for providing a flow of liquid energetic material, a system for delivering sensitizing voids into the flow of liquid energetic material in a series of pulses to provide regions in the liquid energetic material in which the sensitizing voids are sufficiently concentrated to render those regions detonable and regions in the liquid energetic material in which the sensitizing voids are not so concentrated as the detonable regions. In an embodiment the MMDP or PM includes a single pump that is responsible for transporting liquid energetic material to be sensitised and for delivering the resultant explosive composition to a blasthole.

As will be evident, preferably the MMDP/PM allows manufacture and loading into blastholes of explosive compositions without the use of augers and associated hydraulic drives or other heavy equipment. This enables process functionality, loading capacity and safety to be enhanced. The intention is to provide a seamless on-site manufacturing and blasthole loading system that is integrated in mobile form.

In another embodiment the present invention relates to a method of providing in a blasthole an explosive composition comprising a liquid energetic material and sensitizing voids, the sensitizing voids being present in the liquid energetic material with a non-random distribution, which method comprises manufacturing and delivering the explosive composition using a MMDP (or PM) in accordance with the present invention.

In another embodiment the present invention provides a method of (commercial) blasting in which an explosive composition is manufactured and delivered into a blasthole using a MMDP (or PM) in accordance with the present invention, and the explosive composition subsequently initiated/detonated. The explosive composition is used in exactly the same manner as conventional explosive compositions. The explosive compositions are intended to be detonated using conventional initiating systems, for example using a detonator and a booster and/or primer.

In another embodiment the present invention may be applied to achieve specific (designed) bulk detonation energy output in an explosives material by determining a distribution function (DF) template that is representative of that energy output and then formulating an explosive composition consistent with that DF template. This formulation is undertaken in accordance with the present invention by suitable placement and distribution of sensitizing voids within a liquid energetic material. DF templates and related aspects are disclosed in the Applicant's International patent application no. PCT/AU2012/001528.

Notably, the internal structure of the explosive composition is such that the two energetic materials are present as discrete regions. These regions may be distributed uniformly or randomly throughout the composition. The volume proportion, size and spatial arrangement of the regions define the bulk explosive structure. It has been found that the nature of the energetic liquids used and the bulk structure of the resultant explosive composition influences the energy release characteristics of the explosive composition. Thus, the voids, after their reaction determine amount of shock energy and the regions of void-free liquid energetic material determine the heave energy. Quantitatively, the amount of shock energy is a function of the "total voidage volume" and the amount of heave energy is a function of the void-free component volume fraction.

Importantly, this allows the energy release characteristics of an explosive composition to be understood and controlled by varying the combination of energetic liquids used and/or the arrangement of the energetic liquids within the bulk of the explosive composition. In turn this enables the detonation properties of the explosive composition to be tailored to particular rock/ground types and to particular mining applications. As will become clear, the formulations that may be produced in accordance with the present invention may be varied by components selection and/or by manipulating process parameters, such as flow rates of components, and/or by varying hardware componentry that is used. The invention may thus be readily applied to vary explosive formulation design, even between individual blastholes.

Broadly speaking, the design aspect of the present invention is likely to involve the following sequence of steps.

1. Select the density of the void-free liquid energetic material (e.g. emulsion) being used and the desired density of the explosive composition to be formulated.
2. Calculate the total volume of the voids to be incorporated into the void-sensitized emulsion stream to achieve the required density for the explosive composition to be formulated (alternatively, set the metering volume of gassing solution to be added).
3. Select the mean size of the sensitizing voids to be used for sensitization. This will involve selecting the size and number of "static mixer inserts" conditions for gassing reaction.
4. Select the DF template to obtain desirable VOD (shock/heave ratio).
5. Calculate the required density of the void-sensitized flow stream (conventional material) that gives the "selected" final product density, when mixed with void-free flow stream at selected volume ratios of void-sensitized and void-free flows.
6. Select suitable process conditions for producing the desired internal structure having regard to flow rates and flow conditions (typically laminar flow conditions).

Throughout this specification and the claims which follow, unless the context requires otherwise, the word "comprise", and variations such as "comprises" and "comprising", will be understood to imply the inclusion of a stated integer or step or group of integers or steps but not the exclusion of any other integer or step or group of integers or steps.

The reference in this specification to any prior publication (or information derived from it), or to any matter which is known, is not, and should not be taken as an acknowledgment or admission or any form of suggestion that that prior publication (or information derived from it) or known matter forms part of the common general knowledge in the field of endeavour to which this specification relates.

BRIEF DISCUSSION OF FIGURES

FIG. 1 is a schematic illustrating how a void-sensitized liquid energetic material may be produced in accordance with an embodiment of the invention.

FIGS. 2-9 correspond to FIGS. 1-8 from PCT/AU2012/001527.

Future 6 is a photograph showing an experimental arrangement employed in the examples.

Figure 7:
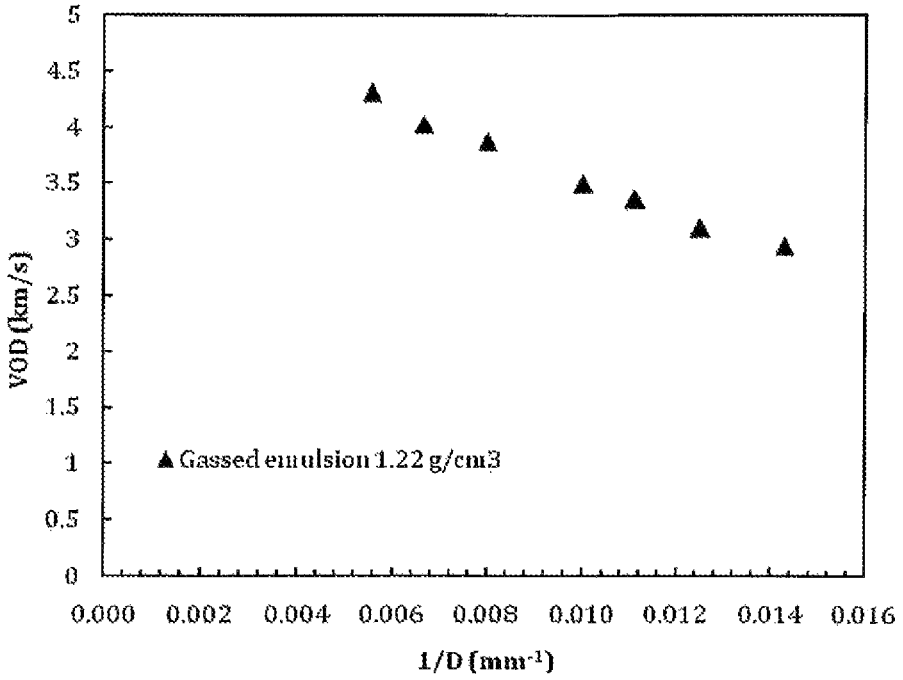
Figure 8:
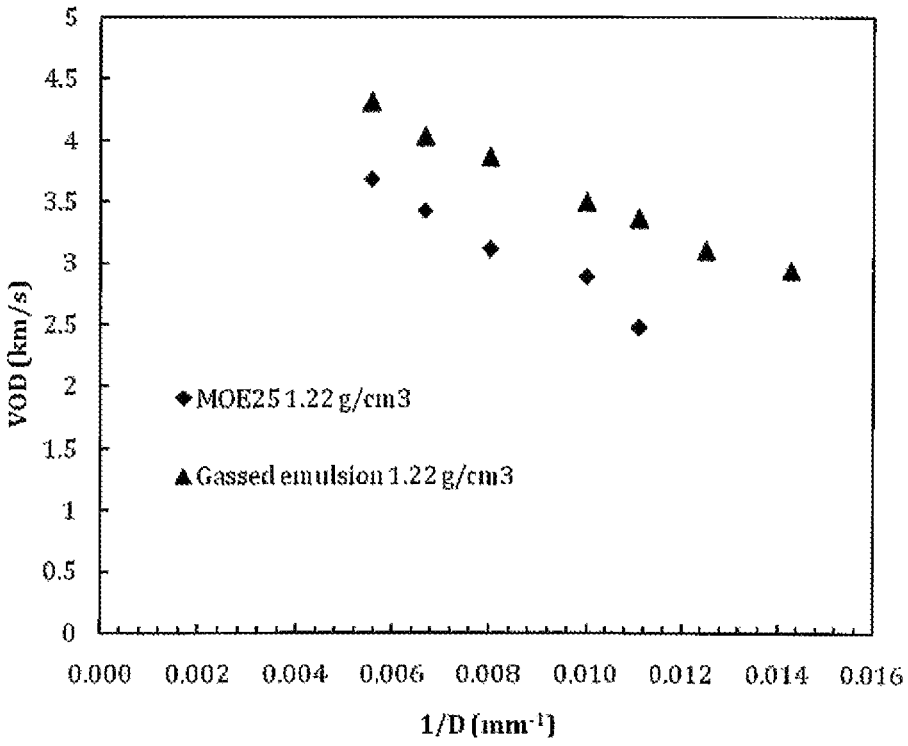
Figure 9:
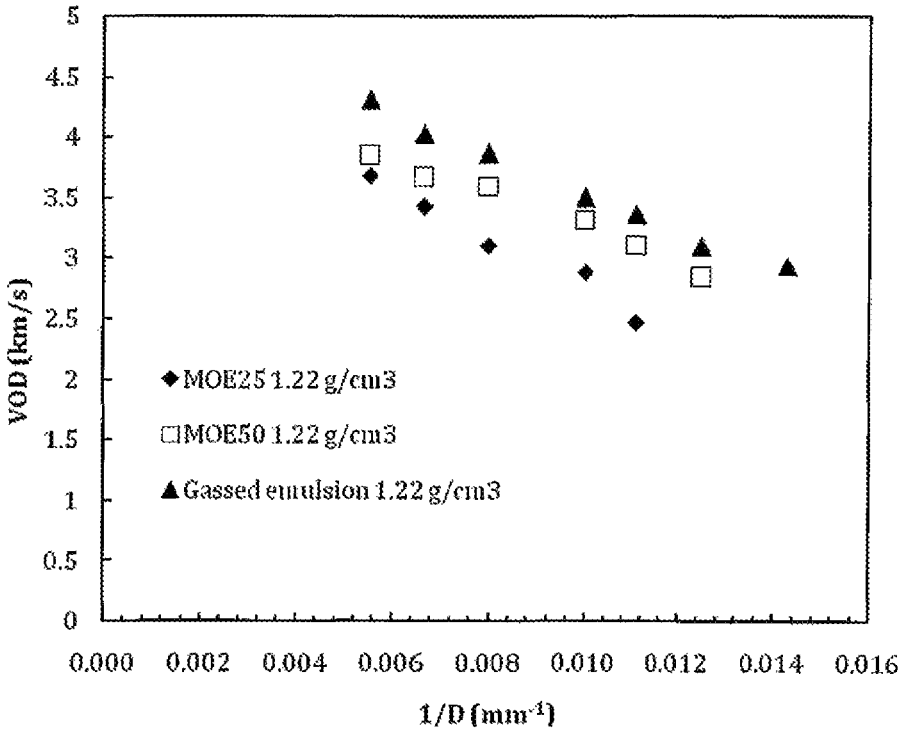

FIGS. 7-9 are graphs illustrating results obtained in the examples.

FIGS. 10-28 correspond to FIGS. 1-19 from PCT/AU2012/001528.

Figure 10:
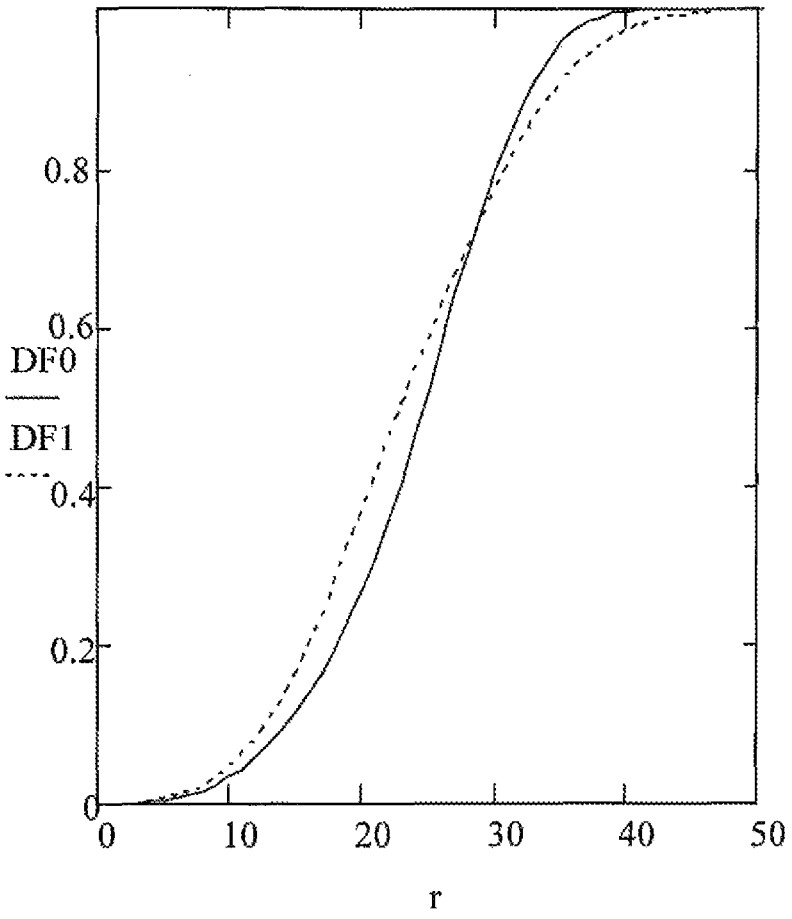

FIG. 10 shows Distribution Function templates for conventional void-sensitized explosive formulations.

Figure 11:
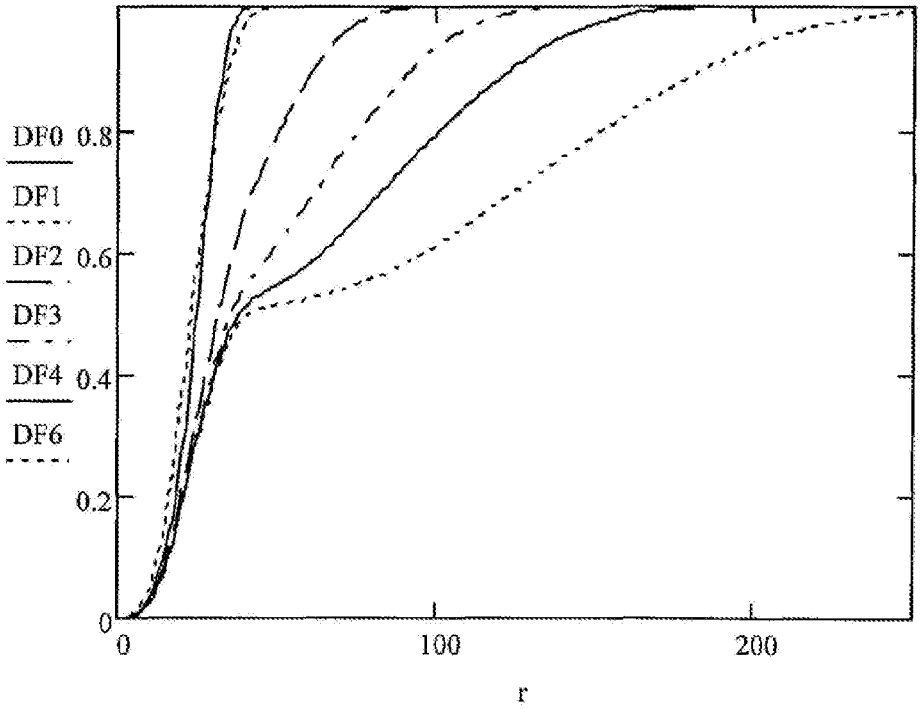

FIG. 11 shows Distribution Functions templates for conventional and non-conventional void-sensitized explosive formulations.

Figure 12:
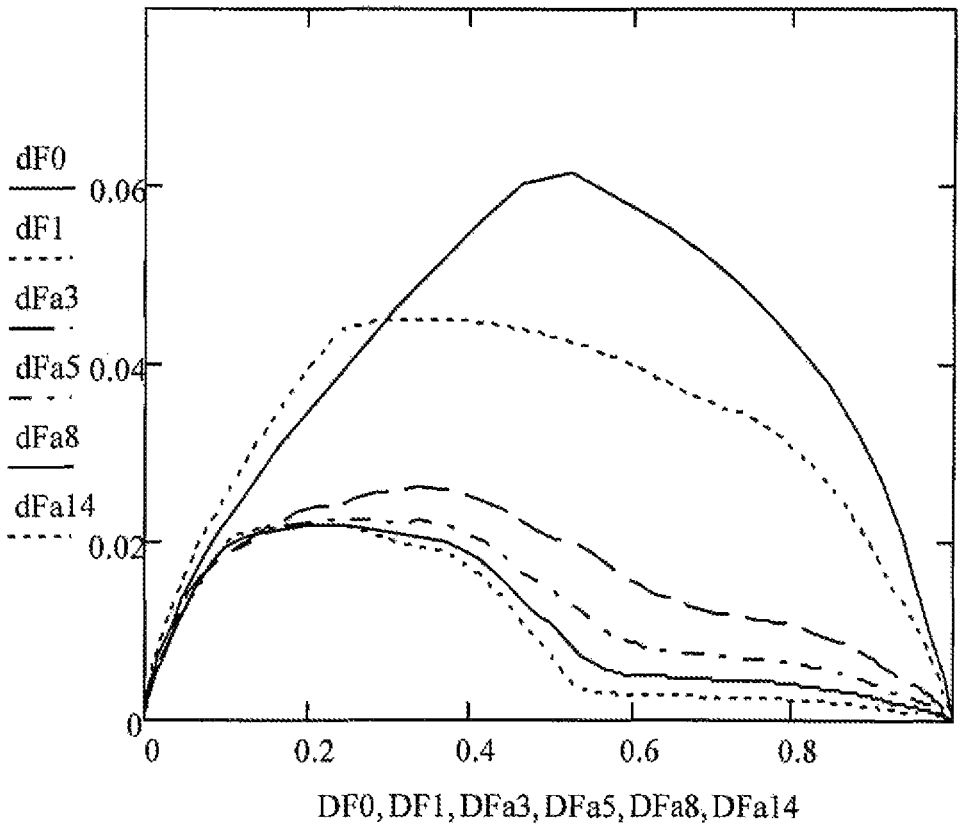

FIG. 12 shows the differential of Distribution Functions for conventional and non-conventional void-sensitized explosive formulations.

Figure 13:
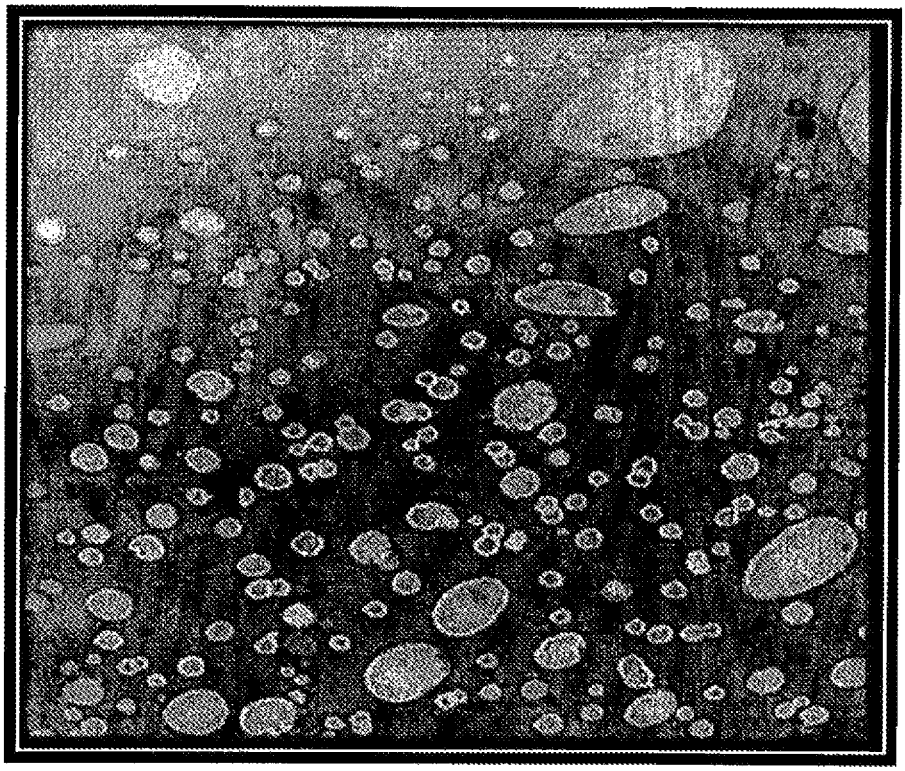

FIG. 13 is an X-ray image of a conventional void-sensitized explosive formulation.

Figure 14:
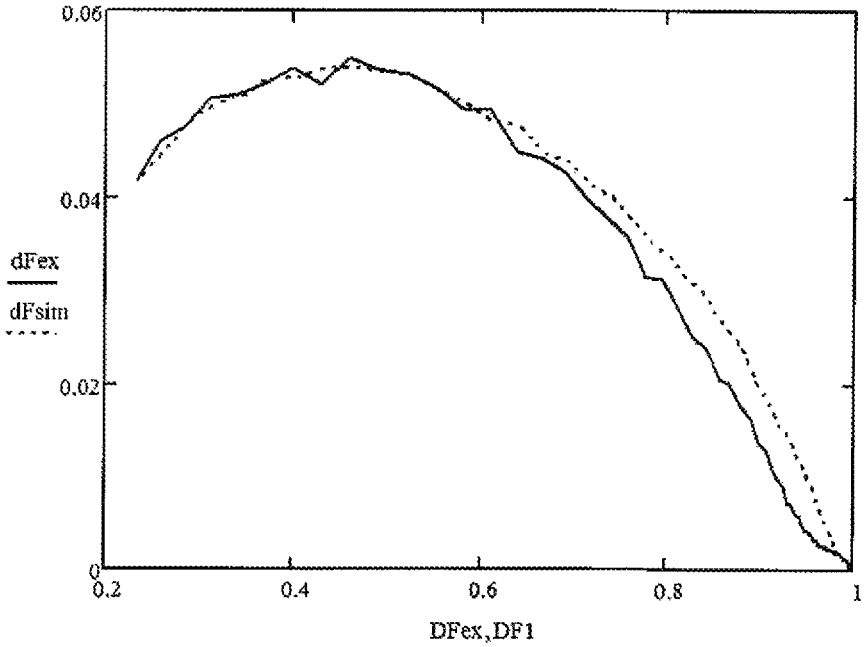

FIG. 14 shows the differential of Distribution Functions for conventional and non-conventional void-sensitized explosive formulations.

Figure 15:
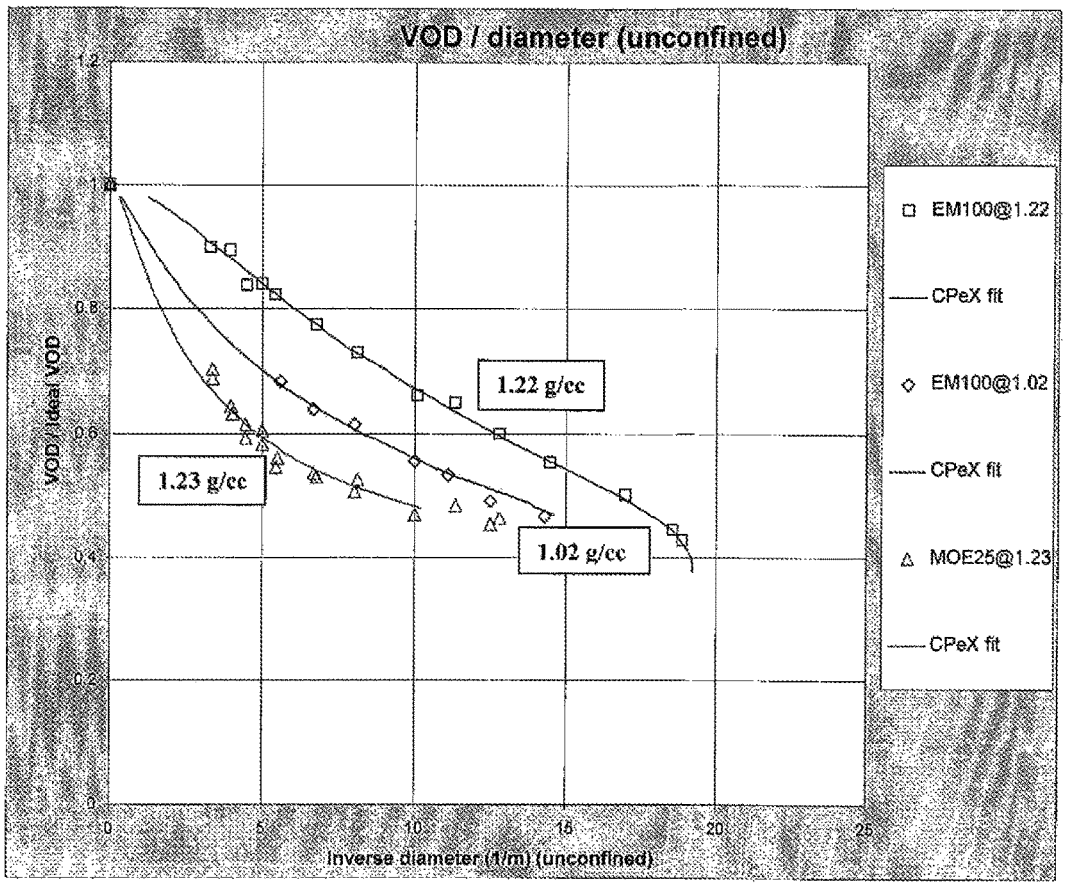

FIG. 15 is a plot comparing VOD against inverse/diameter for two conventional void-sensitized explosive formulations and for one non-conventional void-sensitized explosive formulation.

Figure 16:
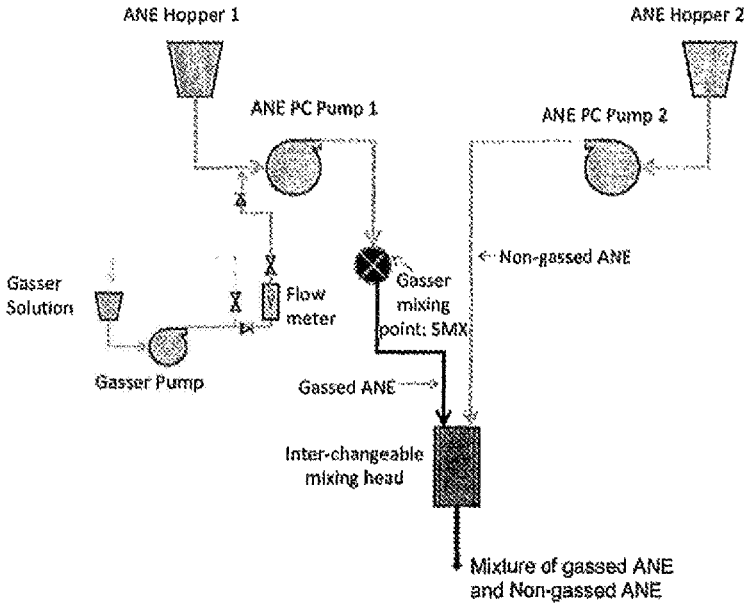

FIG. 16 is a schematic illustrating an apparatus referred to in the examples.

Figure 17:
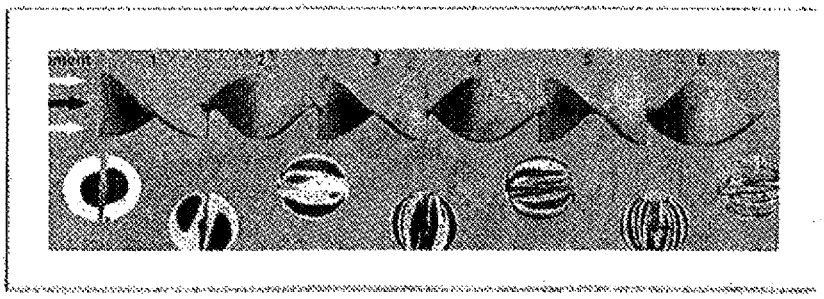

FIG. 17 is a schematic illustrating a mixing element referred to in the examples.

Figure 18:
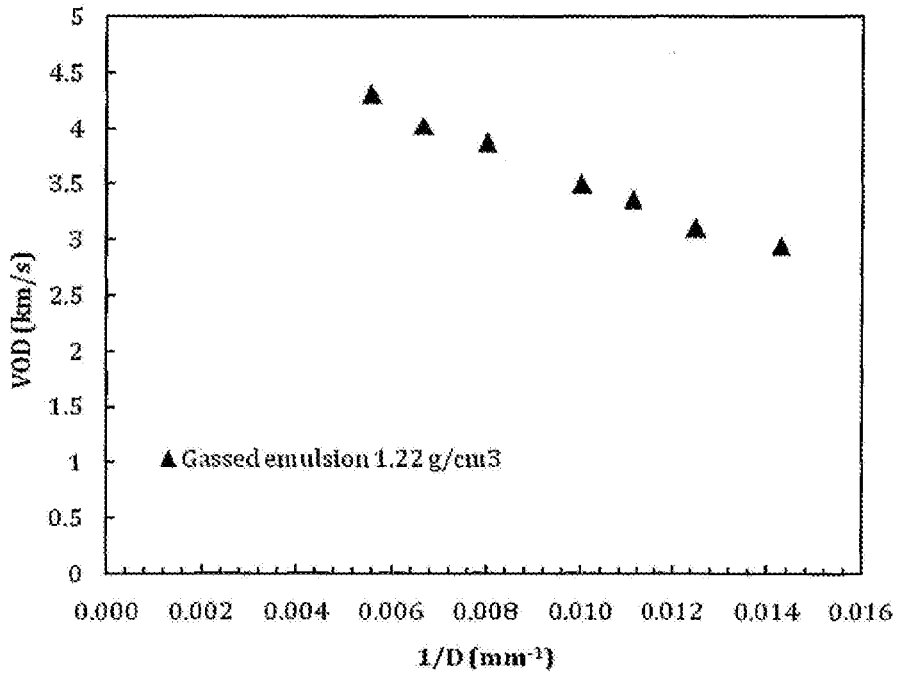
Figure 19:
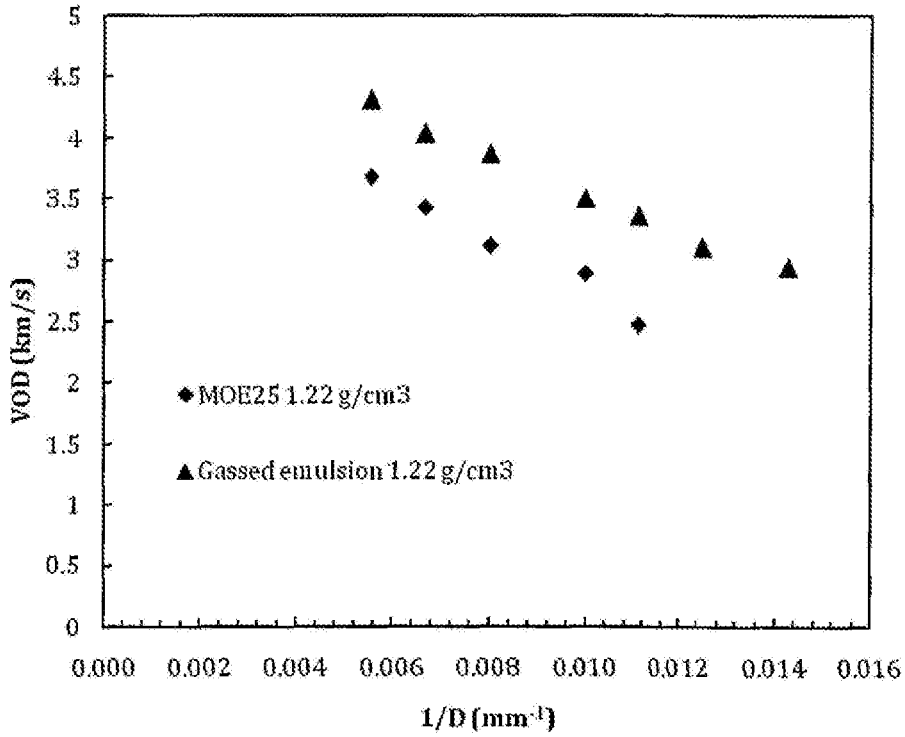
Figure 20:
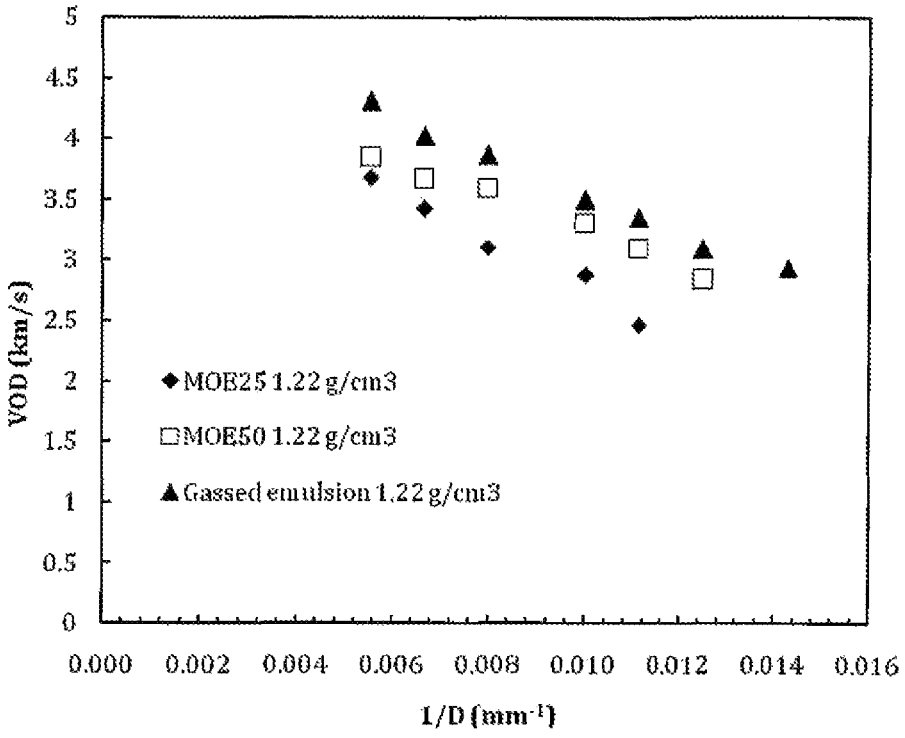

FIGS. 18-20 are graphs illustrating results obtained in the examples.

Figure 21:
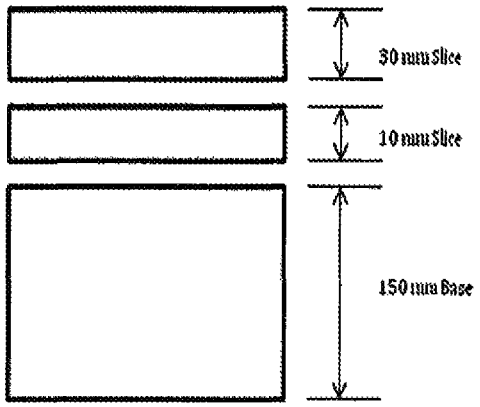

FIG. 21 is a schematic illustrating a container used for obtaining emulsion samples for determining distribution function.

Figure 22:
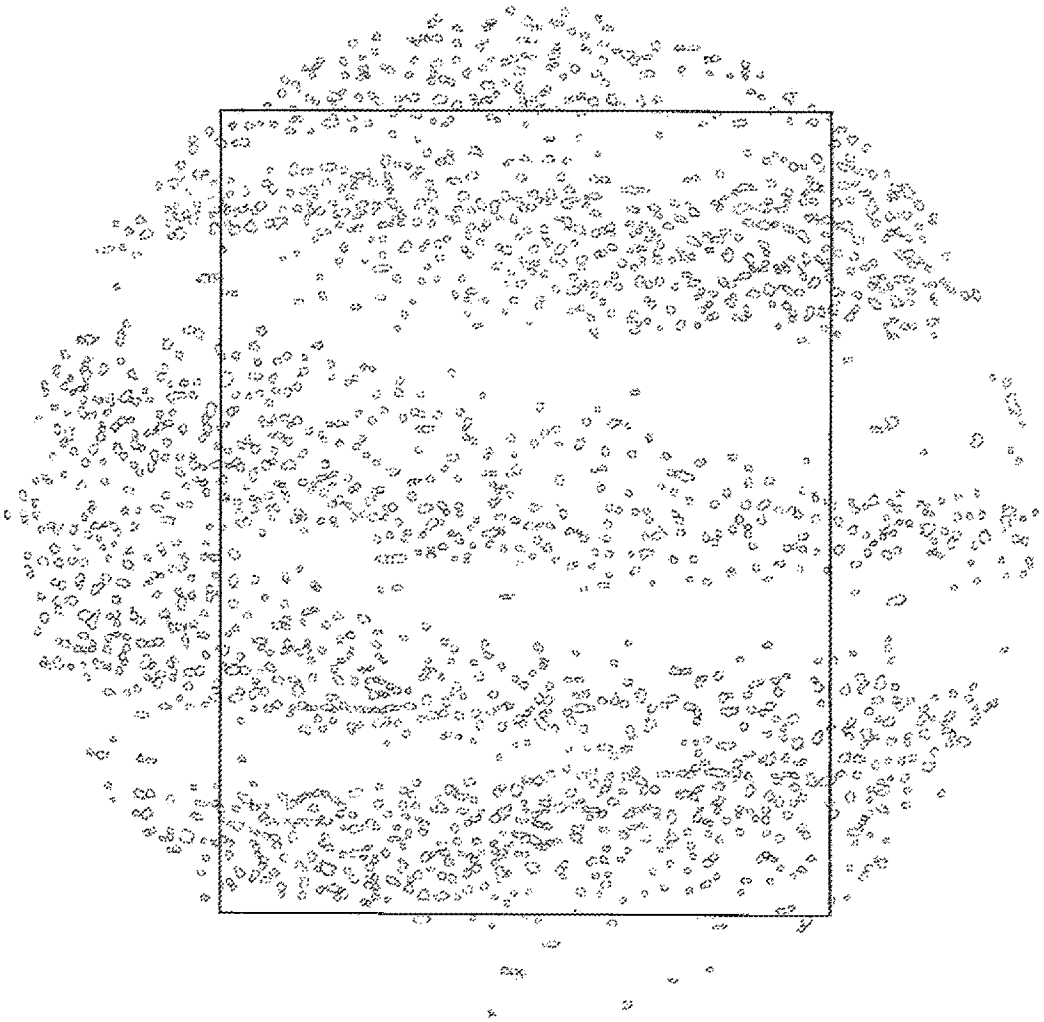

FIG. 22 is a processed image of an explosive material as referred to in the examples.

Figure 23:
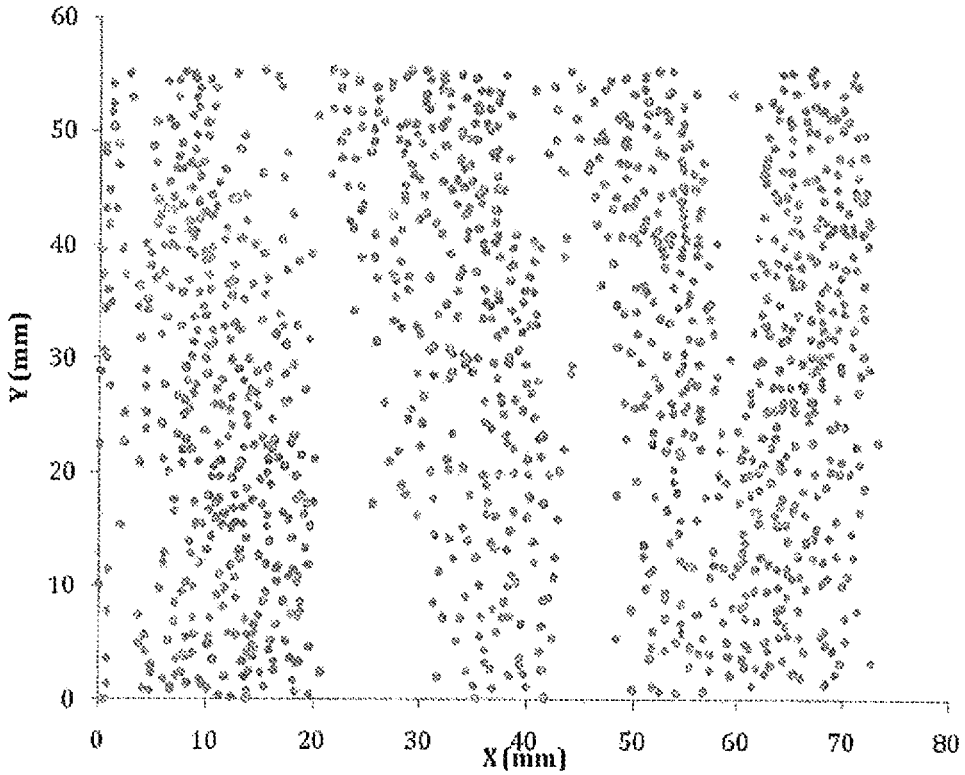
Figure 24:
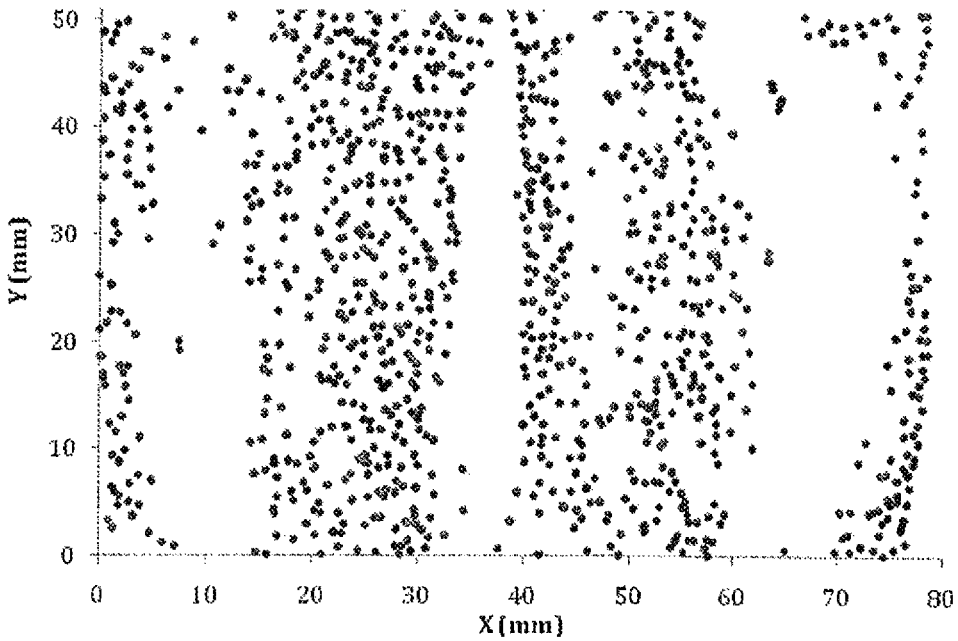
Figure 25:
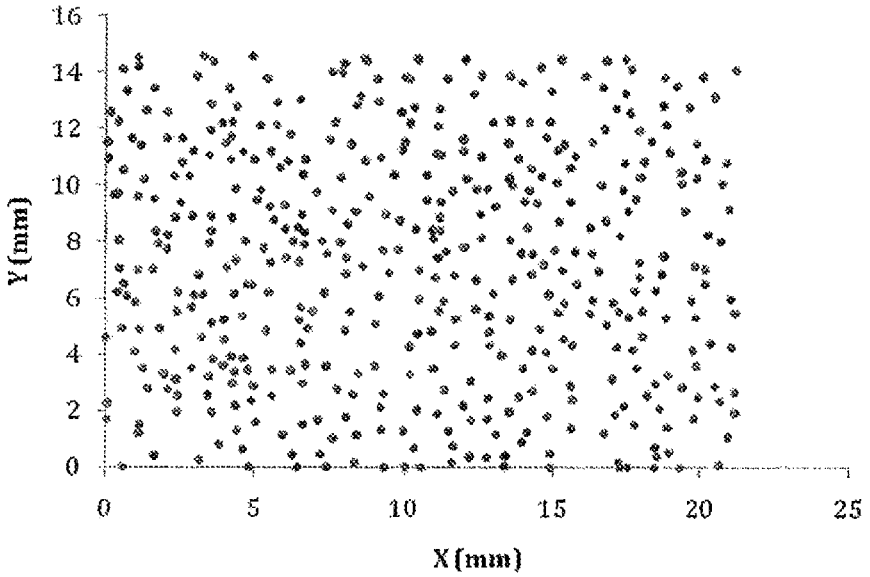

FIGS. 23-25 are plots of bubble position against distance as referred to in the examples.

Figure 26:
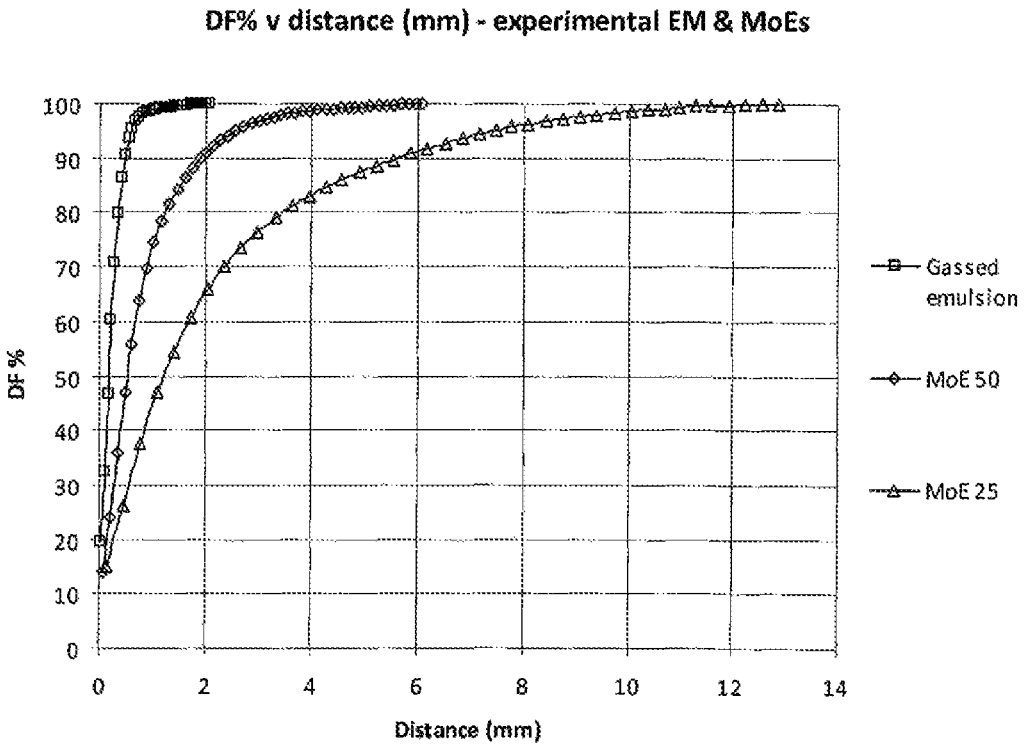

FIG. 26 is a plot of cumulative fraction versus separation distance for formulations referred to in the examples.

Figure 27:
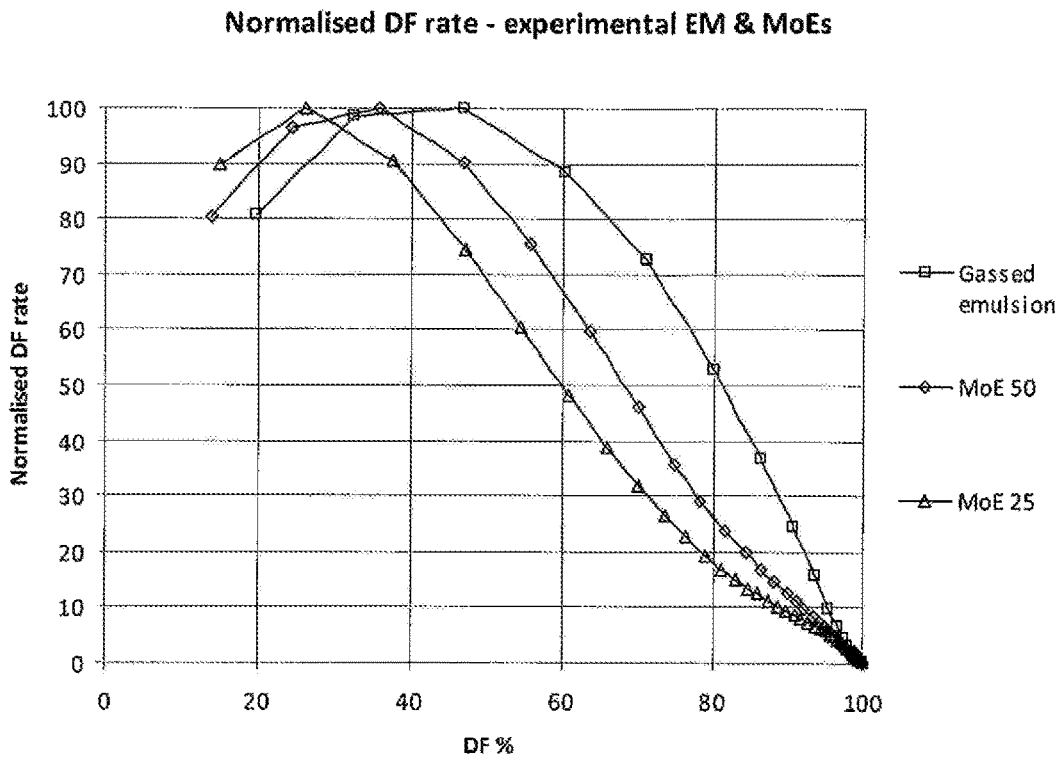

FIG. 27 is a plot of normalized distribution function rate versus cumulative fraction for formulations referred to in the examples.

Figure 28:
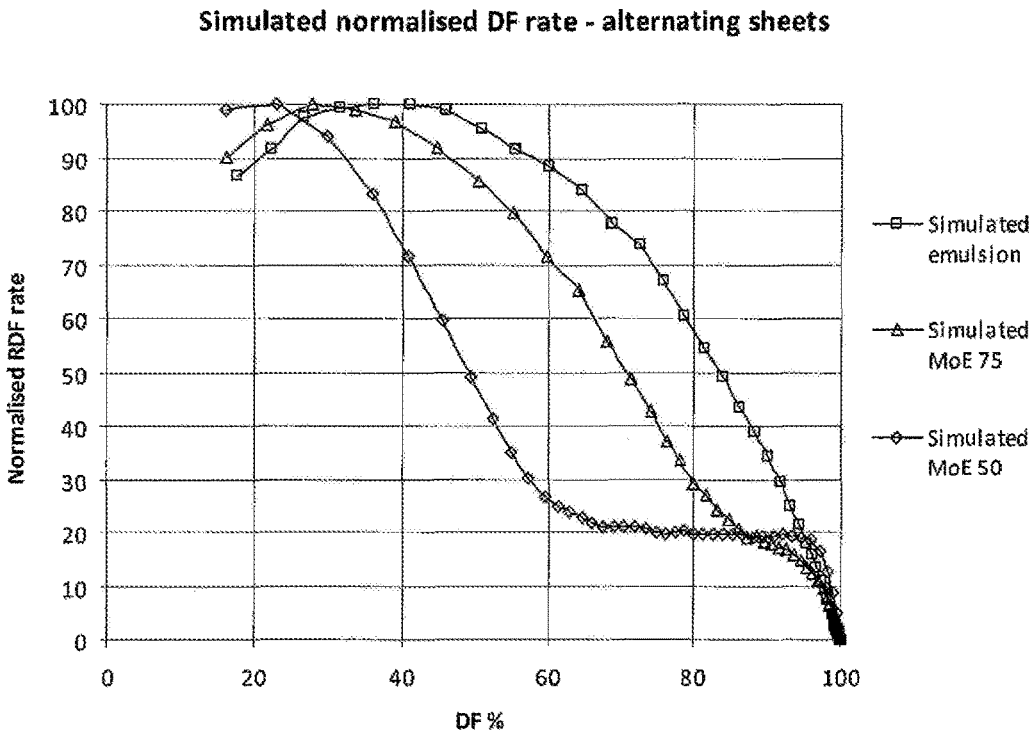

FIG. 28 is a plot of distribution function rate versus cumulative fraction for simulated formulations referred to in the examples.

DETAILED DISCUSSION OF THE INVENTION

The present invention seeks to provide tailored blasting solutions by use of equipment (MMDP or PM) that has the capability to manufacture and deliver to a blasthole an explosive composition having a non-random distribution of sensitizing voids distributed in a liquid energetic material. The explosive characteristics of such explosive compositions are directly related to the distribution of sensitizing voids present and the invention provides methodologies by which this internal structure may be adjusted in a batch-wise fashion so that the characteristics and thus the blasting performance of explosive composition may be varied between blastholes, as required. This would be done in a pre-determined manner in accordance with an overall blast design. In allowing such variation to be achieved in a practical and economic manner, the present invention may provide a further parameter that can be used to optimize the performance of a blast.

In the context of the present invention, the term "explosive composition" means a composition that is detonable per se by conventional initiation means at the charge diameter being employed.

Herein the term "liquid energetic material" is intended to mean a liquid explosive that has stored chemical energy that can be released when the material is detonated. Typically, a liquid energetic material would require some form of sensitization to render it per se detonable. Thus, the term excludes materials that are inherently benign and that are non-detonable even if sensitized, such as water. The energetic materials used in the invention are in liquid form, and here specific mention may be made of explosive emulsions, water gels and slurries. Such emulsions and water gels and are well known in the art in terms of components used and formulation. The invention is believed to have particular applicability in the context of producing emulsion explosive compositions by sensitizing emulsion compositions.

The explosive compositions manufactured in accordance with the present invention have a characteristic structure with respect to the distribution of sensitizing voids in a liquid energetic material. One skilled in the art will readily understand what is meant by sensitizing voids in this context. The sensitizing voids may be glass micro-balloons, plastic micro-balloons, expanded polystyrene beads, or any other conventionally used (solid) sensitizing agent. However, it is possible to implement the present invention using gas as the sensitizing agent. For example, this may achieved using a chemical gassing solution that react with one or more components of a liquid energetic material to generate gas bubbles, and it is these gas bubbles that have a sensitizing effect. It will be appreciated that when such chemical gassing solutions are used in the method of the present invention, sensitizing voids per se are not being delivered into the liquid energetic material. Rather, a chemical gassing solution would be delivered into the liquid energetic material and, since the gas-generating reaction is not instantaneous but rather slow, chemical gassing of the liquid energetic material would take place subsequently to the gassing solution addition. The effect is still the same in terms of achieving the desired arrangement of voids in the explosive composition that is produced but the mechanism of void production is obviously different. The chemical gassing solution may be delivered as droplets into the liquid energetic material.

Herein unless explicitly stated or context clearly dictates otherwise, the term sensitizing voids is intended to embrace the use of solid and/or gaseous sensitizing agents as are commonly used in the art. Likewise, unless explicitly stated or context clearly dictates otherwise, reference to the delivery of sensitizing voids into a liquid energetic material is intended to embrace the delivery of sensitizing agents per se and also the delivery of chemical gassing solution that will give rise to gas bubbles that provide a sensitizing effect. Generally, when a chemical gassing solution is used the present invention should be implemented so that the gassing reaction yields gas bubbles after blasthole loading. Attempts to pump a pre-gassed liquid energetic material are likely to result in loss of gas bubbles and/or coalescence of gas bubbles, and these effects are undesirable with respect to sensitization.

The MMDP described above is mobile in the sense that it may readily be moved between blastholes in a blastfield. The MMDP usually takes the form of a vehicle (truck) that is equipped with the necessary componentry to undertake manufacturing and delivery of explosive compositions as required in the context of the invention.

The MMDP may comprise: a source for supplying a liquid energetic material; a delivery line for conveying a stream of the liquid energetic material from the source; a void delivery system for delivering sensitizing voids into the stream of liquid energetic material in a series of pulses; and a blasthole loading hose. The source may be a storage tank containing the liquid energetic material. However, in an embodiment, the liquid energetic material may be supplied directly as it is being produced. In this case the source would be facility, system or device that produces the liquid energetic material. Thus, the MMDP may also be equipped with chemicals and componentry to produce the liquid energetic material as it is required.

In an embodiment the liquid energetic material is supplied from a storage tank comprising at least two independent compartments and a valve for controlling which compartment feeds the delivery line. Thus, a single storage tank may be equipped to provide multiple types of liquid energetic material each having different characteristics. This provides increased flexibility in terms of the range of explosive compositions that can be produced with the valve regulating which liquid energetic material is being supplied to the delivery line.

As a variant of this embodiment the storage tank may comprise at least two independent compartments, a supply line extending from each compartment and a valve for controlling which supply line feeds the delivery line. When each compartment includes a liquid energetic material having different characteristics the same production flexibility may be achieved.

In an embodiment MMDP has a high volume storage tank (for example 10,000 to 35,000 liters) for liquid energetic material. The MMDP may be constructed by suitable modification of a vehicle equipped with a large volume storage tank and associated pump componentry for delivery from the tank. This modification will involve fitting to the vehicle the various componentry required to implement the methodology of the invention so that manufacture and delivery into a blasthole of explosive composition can be undertaken using liquid energetic material from the storage tank. It may be preferred that the storage tank is of high volume, such as 10,000 to 35,000 liters.

In an embodiment of the invention that the PM is adapted to be retro-fitted to an existing mobile manufacturing unit (MMU). This embodiment allows existing MMUs to be modified in order to undertake manufacturing and loading of explosive compositions in accordance with the present invention.

In another embodiment the PM is provided in a container, on a trailer or on a skid, pallet, flat tray or the like. In this case the PM is not self-propelling and it must be moved from location to location. The PM may be adapted to co-operate with an existing (conventional) MMU and here it may be convenient for the PM to be provided on a trailer that can be pulled by such an MMU.

In another variant the PM may be provided for use in applications where vehicle access is not readily possible, such as in underground or tunnelling applications. In this case the PM may be conveniently provided in a container or on a skid, pallet, flat tray or the like, that can be lifted and taken to the site of intended use, for example using a forklift.

The PM may comprise: a delivery line for conveying a stream of the liquid energetic material from a source for supplying a liquid energetic material; a void delivery system for delivering sensitizing voids into the stream of liquid energetic material in a series of pulses; and a blasthole loading hose. The source may be a storage tank or a facility, system or device that produces the liquid energetic material directly for use without any storage as such. Thus, the PM may also be equipped with chemicals and componentry to produce the liquid energetic material as it is required.

The MMDP and PM will invariably also include a control system to regulate the function of hardware components and their interaction.

The liquid energetic material is typically sourced and supplied from a centralised, dedicated facility and transported to the site of its actual use, where it may be stored under suitably controlled conditions in large bulk hoppers. This is consistent with the typical approach for supply of a liquid energetic material for manufacture of a conventional bulk emulsion explosive. In accordance with the invention, liquid energetic material is transferred from the bulk hopper to a storage hopper provided on the mobile MMDP (or conventional MMU equipped with PM). This may be done using an onboard gear pump or the like, or a bulk hopper service pump.

In accordance with the present invention, the desired internal structure of sensitizing voids within the liquid energetic material may be achieved by controlling the manner in which the sensitizing voids are delivered into a flow/stream of the liquid energetic material. This aspect of the present invention does not rely on blending of individual streams of sensitized and non-sensitized liquid energetic materials. Rather, in accordance with this embodiment sensitizing voids are delivered into a flow (stream) of liquid energetic material in a predetermined and controlled manner to produce within the liquid energetic material a non-random distribution of sensitizing voids. The result is an explosive composition that comprises regions that are void rich and regions that are void deficient. When a chemical gassing solution is used, pulses of chemical gassing solution are delivered into the liquid energetic material rather than voids per se. The chemical gassing solution will be provided as droplets into the liquid energetic material. When a chemical gassing solution is used formation of the gas bubbles by chemical reaction involving the chemical gassing solution should take place in the blasthole. In this case, it is important that the required distribution of (droplets of) chemical gassing solution in liquid energetic material is retained following blasthole loading so that gas bubbles will then be generated with the required distribution.

In the following unless otherwise stated, reference to delivering voids into liquid energetic material should also be understood to embrace delivery of chemical gassing solution into the liquid energetic material.

In accordance with the invention, sensitizing voids are delivered into a flow of liquid energetic material in a series of pulses to produce the desired void distribution within the resultant explosive composition, as required. In other words, discrete amounts of sensitizing voids are delivered into the liquid energetic material stream, the delivery of each amount of sensitizing voids being interspersed with no delivery of sensitizing voids into the liquid energetic material. As the liquid energetic material is provided as a flow (rather than static) the pulse or batch-wise delivery of sensitizing voids into the liquid energetic material will lead to void-rich and void-deficient regions in the liquid energetic material.

In accordance with the invention, the structure of the explosive composition produced with respect to void distribution may be manipulated by controlling such things as the flow rate of the liquid energetic material at the location(s) of delivery of sensitizing voids, the amount and type of sensitizing voids (or type and concentration of chemical gassing agent) used, the duration of each pulse of delivery of sensitizing voids (or chemical gassing solution) and the frequency of the pulses. The present invention may be implemented to obtain an explosive composition that has a uniform internal structure with respect to void-rich and void-deficient regions. However, it is also possible to produce explosive compositions in which a uniform internal structure is obtained for a given volume, that uniform structure being varied between volumes within the overall volume of explosive composition produced.

Typically, the liquid energetic material is supplied from storage container or hopper and pumped though a line (tube/pipe) using a suitable pump. The flow rate of the liquid energetic material is generally in the range of 50 to 1000 kg/min, more preferably 50-450 kg/min. The line is adapted to allow pulses of sensitizing voids to be delivered into liquid energetic material as the material flows through the line. A supply of sensitizing voids (or chemical gassing solution) is contained in a separate storage container or hopper that is linked via a suitable delivery line (tube/pipe) to the line through which the liquid energetic material flows.

In an embodiment the hopper (or tank) may include independent compartments for storage and supply of different types of formulation of liquid energetic material, thereby increasing flexibility in the range of explosive compositions that may be produced. The compartments may be provided by internal partitioning of the hopper or tank, each compartment having a delivery hose running off it and valves to control flow of liquid energetic material.

Figure 1:
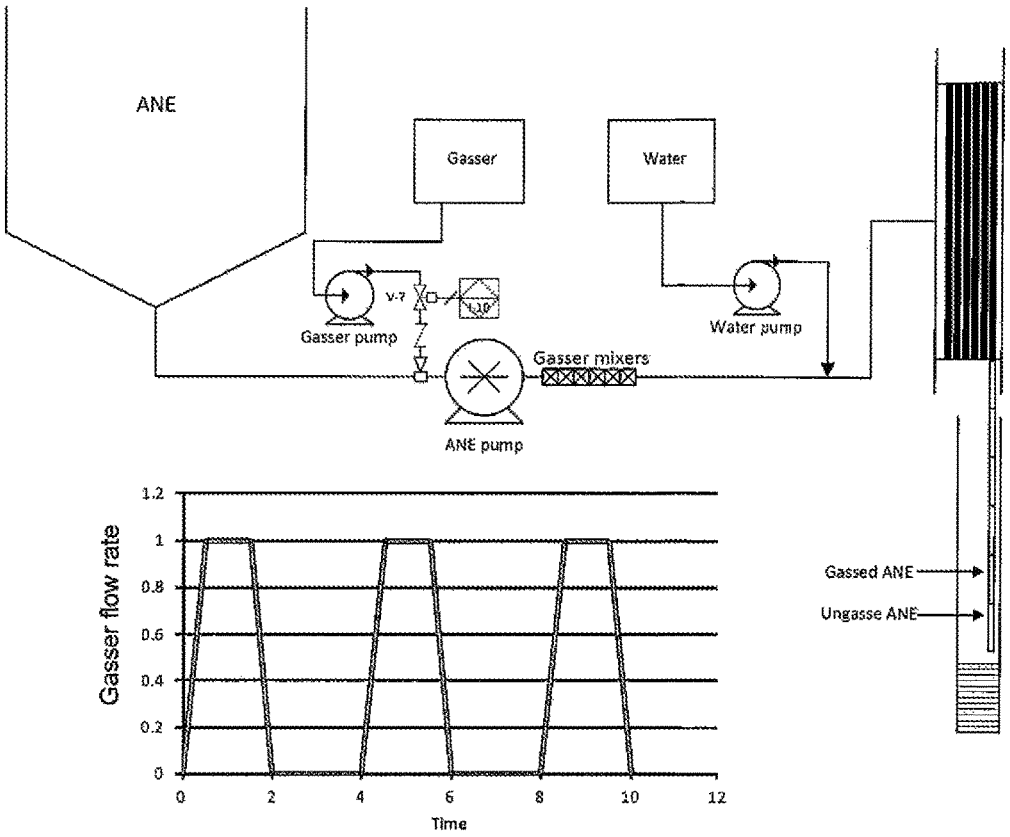

Critical to this embodiment of the present invention is the pulse-wise delivery of sensitizing voids into the liquid energetic material and, to this end, the line for delivering sensitizing voids to the line carrying liquid energetic material will also include a suitable device for metering delivery of sensitizing voids as required. This device may be a flow control valve, which rapidly opens and closes to deliver pulses of sensitizing voids gasser into the flowing liquid energetic material. Alternatively, a reciprocating pump, such as a piston or diaphragm pump, or the like, could be used to deliver pulses of gasser without the need for a flow control valve. Preferably, each pulse of delivery of sensitizing voids has an abrupt start and end point to provide changes in void concentration that are as abrupt as possible. FIG. 1 shows one possible pulse profile and it will be noted that commencement of delivery and cessation of delivery occurs rapidly. It will also be noted that the duration of delivery and period between pulses is consistent in the profile depicted in FIG. 1. The pulse profile in terms of duration of delivery, delivery rate, concentration delivered may be uniform or non-uniform.

Sensitizing voids (or chemical gassing solution) may be delivered into the liquid energetic material at a single location/delivery point in the line through which the liquid energetic material is flowing. In principle multiple delivery points may be employed provided that the required void structure in the resultant explosive composition is achieved.

It may also be desirable to use some form of mixing device to achieve suitable mixing of sensitizing voids into the volume of liquid energetic material receiving the pulse of sensitizing voids or gasser solution. Generally, mixing will take place immediately after the point at which sensitizing voids are delivered into the liquid energetic material. In embodiments, the mixing is used to achieve a uniform void distribution in a discrete volume of liquid energetic material. Suitable mixing devices are known in the art and their efficacy in the context of the present invention may be easily assessed.

In an embodiment, sensitizing voids are delivered into a liquid energetic material that is not void sensitized. However, it will be appreciated that this is not essential and that the invention may be implemented by delivering voids into a liquid energetic material that is already void sensitized. Here the already void sensitized liquid energetic material may be regarded as a base liquid energetic material. In this case the intention is to produce an explosive composition having a non-random distribution of differentially sensitized regions. It will be appreciated that there will be regions of base liquid energetic material that has been dosed with additional voids.

In an embodiment the invention may be implemented with multiple sources of liquid energetic material (some or all of which may be void sensitized) with the capability of generating independent streams from either source or from each source of liquid energetic material. In such cases, valves will be used to select the source(s) of liquid energetic material from which the independent streams are generated.

In the following discussion reference will be made to using a single source of liquid energetic material, but unless context dictates, this should not be regarded as limiting. Likewise, in the following various aspects of design and componentry combination will be discussed and again this should not be regarded as limiting, unless context dictates otherwise. One skilled in the art will appreciate that certain design features that are discussed may readily be combined with other design features to produce a suitably operative system.

In implementing the invention the pumps used are of conventional design and one skilled in the art would be aware of the types and sizes of pumps to be used to achieve required flow rates, as well as how the pumps are operated in the field. The delivery lines used to convey liquid energetic material/void sensitized liquid energetic material may include flow meters and flow control componentry, but again these would be of conventional design.

Once produced the product having the required internal void distribution (or distribution of droplets of chemical gassing solution) is loaded into a blasthole through a loading hose. To minimize shearing, an annular layer/stream of water may be provided around the product. This approach and suitable water injection system are known in the art.

Care should be taken when delivering components or a product of components into a blasthole so that the desired distribution of components is achieved or maintained. Various factors may influence this including, for example, the rate of pumping and the rate at which the loading hose is withdrawn from the blasthole as loading progresses. Preferably, the hose is initially lowered to the base of the blasthole before starting the pump. Upon starting the pump, the hose may remain stationary until the end of the hose becomes submerged in components/blend being pumped. The hose is then raised in a controlled manner such that the end of the hose remains below the surface of the rising column of component/blend delivered. For this purpose, the hose reel may be powered by a variable speed motor, the speed of which can be matched to the velocity of the rising column.

A specific embodiment of how the present invention may be implemented is now presented. For the purposes of illustration the liquid energetic material used in this specific embodiment is an emulsion of an oxidiser salt (ammonium nitrate) in oil (referred to as ANE in the related figure). This emulsion is sensitized by delivering into it a chemical gassing solution prior to blasthole loading with gas bubbles being subsequently generated in the emulsion following blasthole loading. It will be appreciated however that variations are possible whilst maintaining the fundamental design features of each specific embodiment. For example, different means of sensitization may be employed. The various embodiments are described in the context of a mobile manufacturing and delivery platform but the fundamental design of each embodiment may have wider applicability.

The specific embodiment described may be capable of being retrofitted to existing MMU designs, thereby allowing conventional ANFO/heavy ANFO and void sensitized explosive compositions to be delivered from the same truck.

Specific Embodiment 1

This specific embodiment is illustrated in FIG. 1.

FIG. 1 illustrates an apparatus that may be used to implement an embodiment of the present invention. In the embodiment shown, a chemical gassing solution is used to provide sensitizing voids in the liquid energetic material. The apparatus includes a storage vessel/tank for liquid energetic material (unsensitized ammonium nitrate emulsion; ANE), a single emulsion pump for delivering a flow of emulsion through a line, a chemical gasser solution delivery system, a static mixer (e.g. an SMX type mixer) for dispersing the chemical gasser solution (e.g. sodium nitrite solution), a water system for hose lubrication and a delivery hose.

The chemical gasser solution delivery system includes a flow control valve, which can be rapidly opened and closed thereby delivering carefully metered pulses of chemical gasser solution into the flowing liquid energetic material. Alternatively, a reciprocating pump, such as a piston or diaphragm pump could be used to deliver pulses of chemical gasser solution without the need for a flow control valve. The structure of the product is determined by the duration of the gasser pulses. The pulsing gasser result in "plugs" of gassed emulsion flowing down the hose, forming alternating layers of gassed and ungassed emulsion when loaded into a borehole.

After delivery of chemical gassing solution, the liquid energetic material is delivered into a blasthole through a loading hose. An annular layer of water may be provided in the loading hose to aid lubrication, reducing unwanted shearing as the product is delivered through the hose. A water delivery line and associated pump and valve componentry is shown in FIG. 1 for this purpose. The hose may be provided on a reel system for lowering and raising into and out of a blasthole. Chemical gassing solution added prior to blasthole loading generates gas bubbles after blasthole loading to produce an explosive composition with the desired internal structure.

The height of the explosive column increases as the explosive is loaded into the hole. Preferably, the hose is initially lowered to the base of the borehole before starting the pump. Upon starting the pump, the hose remains stationary until the end of the hose becomes submerged in the explosive. The hose is then raised in a controlled manner such that the end of the hose remains below the surface of the rising column of explosive. For this purpose, the hose reel may be powered by a variable speed motor, the speed of which can be matched to the velocity of the rising explosive column. The aim is to ensure that the product in the blasthole retains the desired structure with respect to the positioning and dimensions of the discrete regions of sensitized and unsensitized liquid energetic material.

As noted, the present invention may be applied to produce explosive compositions of the type described in PCT/AU2012/001527 and PCT/AU2012/001528. For reference the content of each of these International patent applications is discussed in more detail below.

In an embodiment of the invention, the MMDP/PM is also adapted to provide in a blasthole a conventional void-sensitized explosive composition, that is an explosive composition in which the void distribution is random. This may be done by generating a void-containing stream of liquid energetic material using relevant componentry of the MMDP/PM. In this case, the delivery of voids (or chemical gassing solution) into the liquid energetic material is continuous rather than as a series of pulses. This embodiment provides enhanced flexibility with respect to the type of explosive compositions that may be produced using the MMDP/PM of the invention.

This embodiment may actually give rise to an entirely new approach to manufacturing and delivery. Here it may be noted that a single, conventional MMUs may be adapted to provide multiple different types of product depending upon the blast performance required. Thus conventional MMUs may be adapted to provide a "dry" product such as ANFO that must be loaded into a blasthole using augers or and associated heavy hydraulic equipment and pumpable products such as emulsion explosives and blends of emulsion explosives and prill. The fact that the explosive compositions of the invention can be produced to provide the same type of blasting performance as ANFO and prill-containing emulsions means that the same level flexibility in terms of blasting performance can be achieved using fewer products. For example, in the case that a single MMU is adapted to deliver (a) ANFO, (b) a conventional void sensitized emulsion explosive and (c) a conventional void-sensitized emulsion explosives dosed with prill, using the present invention the same flexibility in terms of blasting performance can be achieved by providing (a) a void-sensitized emulsion explosive in which the void distribution is non-random and (b) a conventional void sensitized emulsion explosives. This may give raise to advantages in terms of enables process functionality, loading capacity and safety. Furthermore, it allows the use of augers or other heavy solids handling equipment to be avoided.

Embodiments of the invention are now illustrated with reference to the following prophetic examples.

EXAMPLE 1

A mobile manufacture and delivery platform (MMDP) is used for manufacture and delivery of an explosive with non-random void distribution. The MMDP includes a raw material hopper for ammonium nitrate emulsion (ANE), a pump to convey the emulsion, a gasser addition system for injecting pulses of gasser solution into the flowing ANE stream, static mixers for dispersing the gasser solution, a water injection system for lubricating a delivery hose, a delivery hose mounted on a motorised hose reel and a control system for controlling the emulsion pump speed, gasser pulse volume, gasser pulse duration and hose retraction rate. The gasser delivery system includes a gasser tank, gasser pump, back pressure regulator, flow meter and a control valve for delivering pulses of gasser to the emulsion stream.

Ammonium nitrate emulsion is drawn from a hopper by a progressive cavity pump at a rate of 120 kg/min. The pump is pre-calibrated to determine the required speed to achieve this flow rate. A gasser delivery system is used to supply pulses of 30% sodium nitrite gasser solution to the flowing emulsion stream. Gasser is continually recirculated in a pressurised system of pipes, with the pressure kept constant by means of a back pressure regulator. A branch pipe containing a control valve delivers pulses of the gasser to the flowing emulsion stream. The action of the valve was set by a control system to deliver a 1 second pulse of gasser every three seconds, with 10 g of gasser delivered in each pulse. The emulsion is delivered to the blasthole through a 50 mm internal diameter hose mounted on a motorised hose reel. The hose is lowered to the base of a 10 m deep, 200 mm diameter blasthole prior to starting the pumps, and remains at the base of the hole for the first 20 seconds of pumping. After 20 seconds, the hose is withdrawn at a constant rate keeping the end of the hose below the surface of the rising column of explosive. The pulsed injection of gasser solution results in alternating layers of sensitized and unsensitized emulsion in the blasthole. The explosive is loaded to a collar height of 4 m and is allowed to gas for 1 hour before stemming and initiating with a standard 400 g primer.

The following information is taken from the disclosure of PCT/AU2012/001527. This information should be read in this context. For example, in this section when reference is made to "the invention" or "the present invention", this is a reference to the invention described in PCT/AU2012/001527.

SUMMARY OF THE INVENTION OF PCT/AU2012/001527

In accordance with a first embodiment of the invention there is provided an explosive composition comprising a liquid energetic material and sensitizing voids, wherein the sensitizing voids are present in the liquid energetic material with a non-random distribution, and wherein the liquid energetic material comprises (a) regions in which the sensitizing voids are sufficiently concentrated to render those regions detonable and (b) regions in which the sensitizing voids are not so concentrated, wherein the explosive composition does not contain ammonium nitrate prill.

The explosive composition of the present invention is defined with reference to its internal structure. The liquid energetic material comprising (a) regions in which the sensitizing voids are sufficiently concentrated to render those regions detonable and (b) regions in which the sensitizing voids are not so concentrated, rendering different detonation characteristics. Thus, a charge made up (entirely) of liquid energetic material in which the sensitizing voids are sufficiently concentrated to render the liquid energetic material detonable will have different detonation characteristics when compared with a charge made up (entirely) of liquid energetic material in which the sensitizing voids are not so concentrated. The (regions of) liquid energetic material having lower concentration of sensitizing voids (i.e. those regions "in which the sensitizing voids are not so concentrated" may be per se detonable but with reduced detonation sensitivity when compared with (those regions of) liquid energetic material including higher concentration of sensitizing voids. Alternatively, (the regions of) liquid energetic material having lower concentration of sensitizing voids may be per se non-detonable.

Herein differences in detonation sensitivity relate to the intrinsic sensitivity of the individual regions, and also concentration of the sensitizing voids present within the regions, of liquid energetic material. It is generally accepted that the sensitivity of an energetic material to shock wave initiation is governed by the presence of the sensitizing voids. Shock-induced void collapse due to application of a shock wave is a typical mechanism for hot spot formation and subsequent detonation initiation in energetic materials. The generation of the shock induced hotspots, or regions of localized energy release, are crucial processes in shock initiation of energetic materials. The effectiveness of the shock initiation further depends on the amplitude and duration of the shock wave.

It is to be appreciated that the explosive composition of this first embodiment is distinguished from conventional explosive compositions that are formulated by blending sensitizing voids with a liquid energetic material to provide a sensitized explosive product. In that case the voids will be distributed in the liquid energetic material with a random distribution (no amount of mixing will result in a uniform (non-random) spaced distribution of voids). With this random arrangement of voids it may be possible to identify regions in which voids are present in greater concentrations than in others, but the void distribution is nevertheless random in character and there is no structural or systematic consistency within the energetic material with respect to void distribution.

This is to be contrasted with the present invention in which the voids are present with a non-random distribution to provide regions that are void rich and regions that are void deficient. In accordance with this aspect of the invention the voids are present in the liquid energetic material as clusters, and in this respect the explosive compositions of the invention have some structural and systematic consistency with respect to the organization of the voids. In the context of the present invention the term "clusters" is intended to denote a deliberate, grouped arrangement of voids. This arrangement is non-random in character and is not arbitrary in nature.

In relation to this first embodiment of the invention it will be appreciated that regions of liquid energetic material having a high concentration of voids, i.e. including clusters of voids, will per se have different detonation characteristics form regions which have a lower concentration of voids, or no voids at all. It is a requirement of the invention that the explosive composition includes regions in which the sensitizing voids are sufficiently concentrated to render those regions detonable, and this means that those regions would be per se detonable. In other words an explosive composition having a bulk structure corresponding to that of these regions would be detonable in its own right. As voidage influences detonation characteristics, it follows that those regions in the explosive compositions of the invention that have a lower concentration of voids will per se exhibit different detonation characteristics from those regions in which the voids are more highly concentrated. In accordance with the invention it has been found that providing in a single formulation regions of liquid energetic material that per se have different detonation characteristics allows the bulk detonation characteristics of the explosive composition to be influenced and controlled.

In accordance with a second embodiment of the invention regions having different detonation characteristics due to void concentrations can be provided by the use of distinct liquid energetic materials that are sensitized to different extents and that are combined to form an explosive composition. In this embodiment the explosive composition comprises regions of a first liquid energetic material and regions of a second liquid energetic material, wherein the first liquid energetic material is sensitized with sufficient sensitizing voids to render it detonable and wherein the second energetic liquid has different detonation characteristics from the sensitized first liquid energetic material. The (base) liquid energetic materials may be the same or different, although typically the same liquid energetic material is used. When different they will have different physical and chemical properties, such as density and composition.

In embodiments of the invention the explosive compositions of the present invention do not need to rely on ammonium nitrate prill or like material to modify the blasting properties of the explosive composition. Rather, the blasting properties of the explosive composition are directly attributable to the individual regions (and possibly to the liquid energetic material used in those regions where multiple energetic liquids are employed) from which the composition is made up. In accordance with the present invention this approach allows explosive compositions to be formulated that have energy release characteristics (in terms of shock and heave energies) that are at least comparable to conventional prill-containing explosive formulations.

In an embodiment the explosive compositions of the invention do not need to contain any solid oxidiser components or fuels, such as prill, and this means that they can be pumped with relative ease. Thus, related to the first embodiment of the invention, the invention provides an explosive composition consisting of, or consisting essentially of, a liquid energetic material and sensitizing voids, wherein the sensitizing voids are provided in the liquid energetic material with a non-random distribution, and wherein the liquid energetic material comprises (a) regions in which the sensitizing voids are sufficiently concentrated to render those regions detonable and (b) regions in which the sensitizing voids are not so concentrated.

Related to the second embodiment of the invention, the explosive composition may consist of, or consist essentially of, regions of a first liquid energetic material and regions of a second liquid energetic material, wherein the first liquid energetic material is sensitized with sufficient sensitizing voids to render it detonable and wherein the second energetic liquid has different detonation characteristics from the sensitized first liquid energetic material.

In these embodiments the expressions "consisting of" and variations thereof are intended to mean that the explosive composition contains the stated components and nothing else. The expressions "consisting essentially of" and variations thereof are intended to mean that the explosive composition must contain the stated components but that other components may be present provided that these components do not materially affect the properties and performance of the explosive composition.

The present invention also provides a method of producing an explosive composition, the method comprising providing sensitizing voids in a liquid energetic material, wherein the sensitizing voids are provided in the liquid energetic material with a non-random distribution, and such that the liquid energetic material comprises (or consists of or consists essentially of) (a) regions in which the sensitizing voids are sufficiently concentrated to render those regions detonable and (b) regions in which the sensitizing voids are not so concentrated.

Consistent with the second embodiment of the invention, there is also provided a method of producing an explosive composition, the method comprising (or consisting of or consisting essentially of) combining together a first liquid energetic material and a second liquid energetic material to provide regions of the first liquid energetic materials and regions of the second liquid energetic material, wherein the first liquid energetic material is sensitized with sufficient sensitizing voids to render it detonable and wherein the second energetic liquid has different detonation characteristics from the sensitized first liquid energetic material.

As another variant, the present invention enables explosive compositions to be formulated with reduced quantities of ammonium nitrate prill when compared with conventional prill-containing explosives, whilst achieving the same detonation energy balance as such conventional explosives. Accordingly, the present invention also provides an explosive composition comprising a liquid energetic material and sensitizing voids, wherein the sensitizing voids are present in the liquid energetic material with a non-random distribution, wherein the liquid energetic material comprises (a) regions in which the sensitizing voids are sufficiently concentrated to render those regions detonable and (b) regions in which the sensitizing voids are not so concentrated, and wherein the composition further comprises no more than 25 weight %, preferably no more than 15 weight % and, most preferably, no more than 10 weight %, of solid ammonium nitrate (as AN prill or ANFO) based on the total weight of composition. This represent somewhere between 20 to 50% of the amount of solid AN or ANFO used in conventional explosive compositions.

In this embodiment the solid (prill) component should generally be provided in higher density regions of the liquid energetic material making up the explosive composition, i.e. those regions that do not include sensitizing voids or a reduced level of sensitizing voids when compared with other regions that (are designed to) have a higher concentration of sensitizing voids. For example, this embodiment may be implemented by premixing solid AN prill or ANFO with an unsensitized liquid energetic material prior to blending the unsensitized liquid energetic material with a sensitized liquid energetic material consistent with the general principles underlying the invention.

In this embodiment the detonation characteristics of the explosive composition can be tailored in accordance with the underlying principles of the invention by controlling how voids are placed and concentrated within the liquid energetic material so it is possible to achieve an intended detonation energy outcome without needing to include as much prill as one would do normally. The inclusion of relatively small amounts of AN prill may also be applied to influence detonation characteristics, however. Some applications may benefit from the generation of additional energy from decomposition of the solid component or/and utilizing its free oxygen in further reactions with available fuels. Inclusion of the solid component in void-free regions of liquid energetic material may lead to an increase in the total energy of the composition through reduction of the water content in those regions of liquid energetic material.

The present invention also provides a method of varying the energy release characteristics of a first liquid energetic material sensitized with sufficient sensitizing voids to render it detonable which comprises formulating an explosive composition comprising (or consisting of or consisting essentially of) regions of the first liquid energetic material and regions of a second liquid energetic material, wherein the second energetic liquid has different detonation characteristics from the sensitized first liquid energetic material.

The present invention also provides a method of (commercial) blasting using an explosive composition in accordance with the present invention. The explosive composition is used in exactly the same manner as conventional explosive compositions. The explosive compositions of the invention are intended to be detonated using conventional initiating systems, for example using a detonator and a booster and/or primer.

The context of use of the explosive composition of the present invention will depend upon the blasting properties of the composition, especially with regard to the heave and shock energies of the composition. It will be appreciated however that it is envisaged that, in view of their desirable energy release characteristics, the present invention will provide explosive compositions that can be used instead of conventional ANFO or AN prill-containing formulations. Explosive compositions of the invention may have particular utility in mining and quarrying applications.

Herein the term "liquid energetic material" is intended to mean a liquid explosive that has stored chemical energy that can be released when the material is detonated. Typically, a liquid energetic material would require some form of sensitization to render it per se detonable. Thus, the term excludes materials that are inherently benign and that are non-detonable even if sensitized, such as water. It should be noted however that this does not mean that each liquid energetic material in the explosive compositions of the invention are in fact sensitized. Indeed, in embodiments of the invention, one of the liquid energetic materials is sensitized and another liquid energetic material is not sensitized at all. That said, in other embodiments one of the liquid energetic materials is sensitized and another liquid energetic material is sensitized to a lesser extent.

The energetic materials used in the invention are in liquid form, and here specific mention may be made of explosive emulsions, water gels and slurries. Such emulsions, water gels and slurries are well known in the art in terms of components used and formulation.

In the context of the present invention, the term "explosive composition" means a composition that is detonable per se by conventional initiation means at the charge diameter being employed.

Throughout this specification and the claims which follow, unless the context requires otherwise, the word "comprise", and variations such as "comprises" and "comprising", will be understood to imply the inclusion of a stated integer or step or group of integers or steps but not the exclusion of any other integer or step or group of integers or steps.

The reference in this specification to any prior publication (or information derived from it), or to any matter which is known, is not, and should not be taken as an acknowledgment or admission or any form of suggestion that that prior publication (or information derived from it) or known matter forms part of the common general knowledge in the field of endeavour to which this specification relates.

DETAILED DISCUSSION OF THE INVENTION OF PCT/AU2012/001527

In accordance with the present invention it has been found that the detonation characteristics of a void sensitized liquid energetic material can be controlled by controlling how the voids are arranged within the liquid energetic material. In particular it has been found that the ratio of heave energy to shock energy delivered by detonation of liquid energetic materials sensitized with voids can be significantly increased, compared with existing void sensitized "all liquid" energetic materials, by controlling how the voids are distributed with respect to each other. It is also possible to achieve a high heave to shock energy ratio whilst maintaining higher total energy densities than is available from conventional "all liquid" systems.

Prior to the present invention much has been reported on the use of different types of voids and voidage levels, but there is not believed to have been any systematic investigation of the effect of relative void spatial distribution.

Existing void sensitized liquid energetic materials have a similar (random) spatial distribution of the voids with respect to each other. Only by using voids which provide fuel, such as expanded polystyrene, and with void diameters of 500 μm or more, have higher heave energies been achieved. With the present invention unconventionally high ratios of heave to shock energies with voids sizes from 20 μm to 5 mm can be achieved, and high total energies similar to solid AN prill-containing formulations, can be achieved.

Without wishing to be bound by theory, the mechanisms involved when an explosive composition of the invention is initiated are believed to be as follows. Distribution of the explosive energy between shock and heave is governed by the speed of reactions within the individual sensitized and unsensitized regions. The chemical reactions within the hot spots are fast and exothermic and thus enable detonations by large number of interconnected, small thermal explosions. The number and size of the hot spots controls the sensitivity and speed of detonation reactions within the sensitized region. In this way the sensitized region contributes to the magnitude of the shock energy output. The insufficient number or total absence of hot spots leads to relatively slow reactions (burning) in unsensitized region of energetic liquid. The grain burning mechanism controls the rate of energy release within unsensitized regions of the energetic material. The process hence determines output of the heave energy. Importantly, in accordance with the invention, the energy release characteristics of the explosive composition can be controlled and tailored by varying the void distribution, void volume, the combination of liquid energetic components used and/or the arrangement of the liquid energetic components within the bulk of the explosive composition. In turn, this enables the detonation properties of the explosive composition to be tailored to particular rock/ground types and to particular mining applications.

The present invention may be of particular interest when applied to the use of emulsion explosives as liquid energetic materials. Emulsion-based bulk explosives do not have blasting characteristics, such as velocity of detonation (VOD), equivalent to conventional ANFO or AN prill-containing explosives. However, emulsion explosives do have desirable properties in terms of water resistance and the ability to be pumped. Accordingly, emulsion-based explosive compositions of the present invention may be used as an alternative to ANFO and AN-containing products. This will allow such conventional explosives compositions to be replaced with products that are emulsion-only based. Accordingly, the present invention also provides the use of an emulsion explosive composition in accordance with the present invention in a blasting operation as an alternative to ANFO or AN-containing product.

In this context the emulsion explosives are typically water-in-oil emulsions comprising a discontinuous oxidizer salt solution (such as ammonium nitrate) dispersed in a continuous fuel phase and stabilized with a suitable emulsifier. Sensitization is achieved in conventional manner by inclusion of "voids" such as gas bubbles or micro-balloons, e.g. glass or polystyrene micro-balloons. This will influence the density of the emulsion.

Central to the present invention is the arrangement with which voids are distributed within a liquid energetic material. Thus, the explosive compositions of the present invention include regions that are void rich (i.e. relatively concentrated) and regions that are void deficient (i.e. not so concentrated), these regions per se having different detonation characteristics. Combining such regions results in a bulk product having novel detonation characteristics as compared to the detonation characteristics of the individual regions that are present. As will become apparent there is great scope for modifying the internal structure of the bulk product based on its constituent components/regions and in turn this advantageously provides great scope for tailoring the explosive characteristics of the product.

In accordance with the present invention it may be possible to achieve one or more of the following practical benefits otherwise not attainable with a homogeneous emulsion-only void sensitized explosive compositions:

- Excellent combination of heave properties and fragmentation.
- Steady low VOD during detonation.
- Ability to adjust/match detonation energy/properties to rock properties.
- Control of energy release rate by proportion of different components in the explosive composition. This enables the invention to deliver high heave or high shock performance to match customer specific applications.

When compared with solid AN-containing formulations, explosive compositions of the invention that are prill-free offer the following benefits:

- Water resistance.
- Liquid explosives enable pumping at higher flow rates and lower pumping pressures leading to faster loading of water filled holes.

In the first embodiment of the invention the explosive composition comprises a liquid energetic material and sensitizing voids, wherein the sensitizing voids are present in the liquid energetic material with a non-random distribution, and wherein the liquid energetic material comprises (a) regions in which the sensitizing voids are sufficiently concentrated to render those regions detonable and (b) regions in which the sensitizing voids are not so concentrated. In this embodiment the internal structure of the explosive composition is characterized by the distribution of voids, the volume ratio of the various regions and the arrangement of the regions. The void distribution may broadly be understood with reference to FIG. 2. This figure shows three types of void distributions in a liquid energetic material (matrix).

Figure 2:
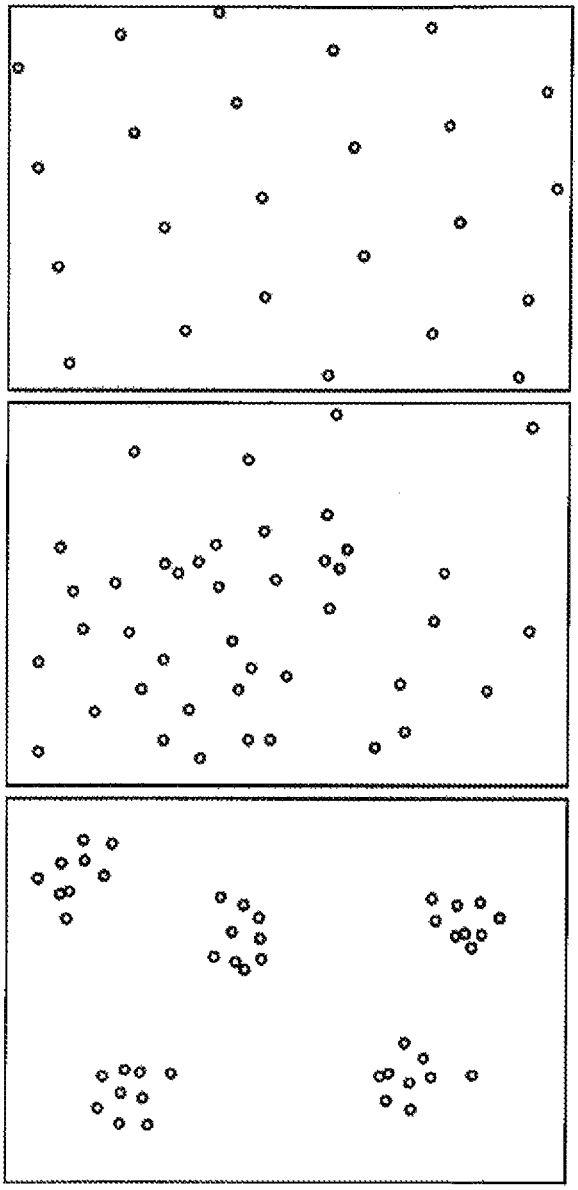
FIG. 2 is a schematic showing possible arrangements of voids in a liquid energetic material.

The top panel of FIG. 2 shows a uniform spaced distribution of voids as would arise with ideal mixing of voids in a liquid energetic material. It will be appreciated that this is arrangement is ideal/hypothetical and would not be found in real systems.

The middle panel of FIG. 2 shows a random arrangement of voids as would arise in practice when formulating a conventional explosive composition by mixing of voids into a liquid energetic material. It might be possible to identify regions that are void rich and different regions that are void deficient but the arrangement is nevertheless random and nothing deliberate has been done at achieve regions having these structural features in terms of void distribution.

The bottom panel of FIG. 2 on the other hand shows an example of clusters of voids distributed throughout a matrix of liquid energetic material, as per the first embodiment of the invention. This arrangement is deliberate rather than arbitrary, and there is some structural and systematic consistency. The bottom panel of FIG. 2 suggests that the regions of void concentration are approximately the same size and occur with an even distribution, but this is not essential. Furthermore, the bottom panel of FIG. 2 shows the use of a single liquid energetic material (matrix). However, this is not essential and the regions differing in void concentration may be achieved by the use of different liquid energetic materials sensitized to different extents.

In another (second) embodiment of the invention the explosive composition comprises regions of a first liquid energetic material and regions of a second liquid energetic material, wherein the first liquid energetic material is sensitized with sufficient sensitizing voids to render it detonable and wherein the second energetic liquid has different detonation characteristics from the sensitized first liquid energetic material. It will be appreciated that this embodiment is related to the first embodiment in that in the second embodiment individual liquid energetic materials are combined to provide the regions having the requisite void concentrations referred to in the first embodiment.

With respect to the second embodiment of the invention, the (internal) structure of the explosive composition is characterized by the volume ratio of each component (liquid energetic material) and the structural arrangement/distribution of the components relative to each other. In the explosive compositions of this embodiment the two components are generally present as (discrete) regions.

In accordance with this embodiment the first and second liquid energetic materials have different detonation characteristics, such as VOD and detonation sensitivity. In one embodiment the first and second liquid energetic materials (e.g. emulsion explosives) are derived from the same base source (e.g. emulsion). For example, in this case, the first emulsion may be produced by void sensitizing a base emulsion, thereby reducing its density, and the second emulsion may be the base emulsion itself. In this case the explosive composition will include discrete regions of basic (unsensitized) emulsion and regions of the sensitized emulsion. The density and blasting characteristics of the resultant explosive composition will be determined and influenced by the individual components from which the composition is formed.

Advantageously, in this second embodiment of the invention the make up and structural characteristics of the explosive composition may be varied in a number of ways and this may provide significant flexibility in terms of achieving particular blast outcomes that have otherwise not been achievable using conventional emulsion-based void sensitized explosive products. Thus, in the embodiment described, where an unsensitized emulsion is provided in combination with a sensitized emulsion, numerous possibilities exist within the spirit of the present invention. The following are given by way of example. It will be appreciated that combinations of the following variants may be employed.

- The relative proportions of the first and second emulsions may be varied.
- The geometry of the individual regions may be varied. For example, for a given volume of emulsion, the first emulsion may be present as small dispersed droplets/domains/zones separated from one another by intervening regions of the second emulsion. Alternatively, the second emulsion may be present as small dispersed droplets/domains/zones separated from one another by intervening regions of the first composition. As a further alternative, the first and second emulsions may be present as discrete domains/zones arranged as a bi-continuous mixture of the two compositions. In an embodiment of the invention the unsensitized phase may be in the form of globules, sheets, rods or bi-continuous structures, such that the smallest dimension of the unsensitized phase is 3 to 5000, for example 5 to 50 times, times the mean diameter of the sensitizing voids.
- The emulsions may be derived from the same or different "base" emulsion.
- One emulsion may form a discontinuous phase and the other emulsion may form a continuous phase. In the example given above, the unsensitized emulsion may form the matrix and the void sensitized emulsion the discontinuous phase.
- It is essential that one of the emulsions that is used be void sensitized (for detonation using the intended initiating system) but the other emulsion does not need to be non-sensitized. Both emulsions may be void sensitized, although in this case the individual emulsions must nevertheless exhibit different blasting characteristics.
- When both emulsions are void sensitized, each emulsion may be sensitized in a different way. For example, one emulsion may be gassed and the other emulsion include micro-balloons, such as expanded polystyrene. As another example, each emulsion may be sensitized with different sizes of micro-balloons.

It will be appreciated from this that the formulation flexibility associated with the present invention allows the production of explosive compositions that have detonation characteristics, such as VOD, to be substantially different from homogeneous emulsion-only void sensitized explosive products having similar composition in terms of liquid energetic material and void sensitization.

The sensitizing voids may be gas bubbles, glass micro-balloons, plastic micro-balloons, expanded polystyrene beads, or any other conventionally used sensitizing agent. The density of the sensitizing agent is typically below 0.25 g/cc although polystyrene spheres may have a density as low as 0.03-0.05 g/cc, and the voids generally have mean diameters in the range 20 to 2000 μm, for example in the range 40 to 500 μm.

Noting the scope for variation in composition formulation that exists, it would in fact be possible to provide a comprehensive suite of explosive compositions tailored to meet different blasting requirements using only a limited number of base emulsion formulations. In turn this may lead to more streamlined logistics, while at the same time possibly lead to lower formulation and operational costs.

Furthermore, the present invention may render useful products that have previously been thought to be unsuitable in the explosives context. For example, by using ammonium nitrate as melt grade only, a range of previously unacceptable ammonium nitrate sources could be used, leading to lower cost explosives.

The present invention also provides a method of (commercial) blasting using an explosive composition in accordance with the present invention. The explosive compositions of the invention are intended to be detonated using conventional initiating systems, for example comprising a detonator and a booster and/or primer. The present invention may be applied to produce explosive composition that detonate at a steady predetermined velocity, with a minimum VOD of 2000 m/s, for example from 2000-6000 m/s in either a confined bore hole, or under unconfined conditions. It will be appreciated that the VOD of an explosive composition in accordance with the invention will be less than the VOD of the component (or region) of the composition having the highest VOD. It is well known that the amount of shock energy at a given explosive density is proportional to the VOD, and as such, reduction in the VOD results in a decrease in shock energy and corresponding increase in heave energy.

Advantageously, the present invention may be used to provide an emulsion-based explosive composition that matches ANFO or an AN prill based product with respect to density and velocity of detonation. For example, if a commercially available product containing AN prill has a density of 1.2 g/cc, this same density could be achieved by using an explosive composition in accordance with the invention in which a non-sensitized emulsion having a density of 1.32 g/cc is used in combination with a void-sensitized emulsion having a density of 0.8 g/cc at a volume ratio of 78:22. The same density could of course be achieved using different volume proportions of emulsions having different densities. For example, a density of 1.32 g/cc could be achieved using the following combinations of densities and volume ratios for the non-sensitized and sensitized emulsions respectively: 1.32 g/cc and 1.0 g/cc at 67:33; 1.32 g/cc and 0.9 g/cc at 73:27; and 1.32 g/cc and 0.8 g/cc at 78:22. The VOD of each explosive composition will be different, and a target VOD may be achieved by varying the volume ratio and density of the emulsion components whilst maintaining density matching with the prill-containing product. In proceeding in this way it is possible to provide emulsion-based explosive compositions that offer similar blasting performance to prill-based products.

Explosive compositions in accordance with the present invention may be made by blending together a first liquid energetic material and a second liquid energetic material to provide regions of the first liquid energetic materials and regions of the second liquid energetic material, wherein the first liquid energetic material is sensitized with sufficient sensitizing voids to render it detonable and wherein the second energetic liquid has different detonation characteristics from the sensitized first liquid energetic material. Blending of the individual liquid energetic materials may take place during loading into a blasthole but this is not essential and blending may be undertaken in advance provided that delivery into a blasthole does not disrupt the intended structure of the explosive composition. The liquid energetic materials used may be the same or different.

Figure 3:
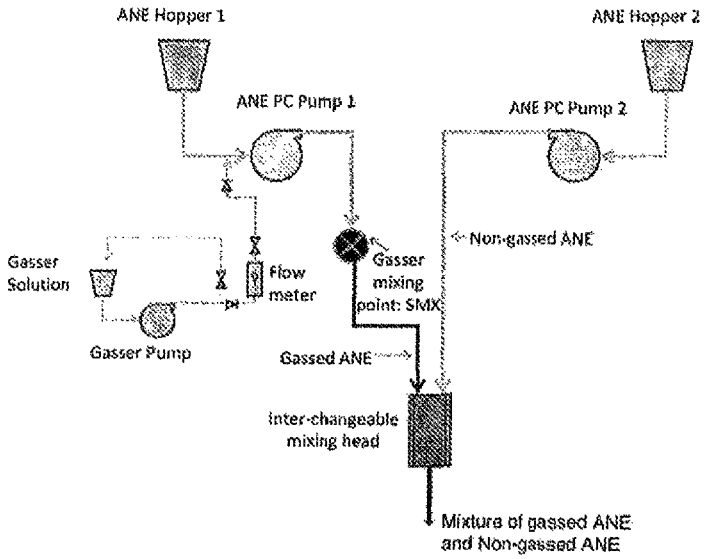
FIG. 3 is a schematic illustrating how a void-sensitized liquid energetic material in accordance with an embodiment of the invention may be produced, as referred to in the examples.
Figure 4:
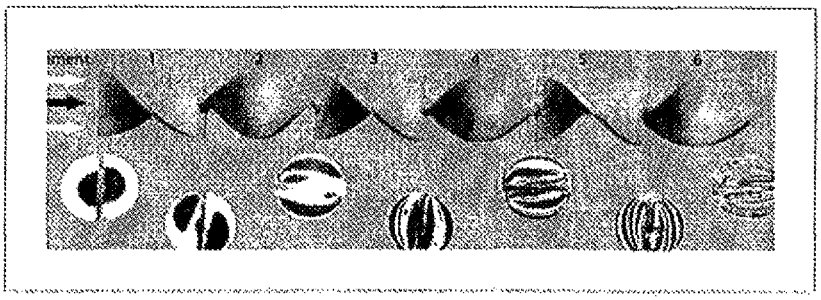
FIG. 4 is a schematic illustrating a mixing element that may be used to produce a void-sensitized liquid energetic material in accordance with an embodiment of the invention.

In an embodiment of the invention an explosive composition may be prepared by mixing of streams of individual components using a static mixer (see FIG. 4 and the discussion below). By this mixing methodology the streams of the individual components are split into sheets that have a mean thickness typically in the range 2 to 20 mm. The characteristics of the sheets can be adjusted by adjusting the mixing methodology, for example by varying the number of mixing elements in the static mixer. The corresponding process diagram is shown in FIG. 3. With reference to that figure the experimental rig comprises two emulsion holding hoppers ANE1 and ANE2. Two progressive cavity (PC) metering pumps PC Pump 1 and PC Pump 2 supply streams of the emulsions into an inter-changeable mixing head. The mass flow of the individual fluid streams is set up by calibration of the metering pumps and cross-checking against the total mass flow via into the inter-changeable mixing head. Blending is done in a continuous manner in the closed pipe of an interchangeable mixing head module.

By way of example, in the fluid stream (1), a void-free ammonium nitrate emulsion (ANE1) is mixed in line with an aqueous solution of sodium nitrite in a gasser mixing point using an arrangement of SMX type static mixers. After completion of the gassing reaction the emulsion stream (1) will have a particular density. The second fluid stream (2) may consist of a void-free ammonium nitrate emulsion having a higher density than the gassed emulsion stream (1).

The inter-changeable mixing head is comprised of two parts. The first part has two separate inlet channels for the entry of each emulsion stream and a baffle just before the entrance to the first static mixer element to ensure separation of the individual streams in the mixing section. The interchangeable mixing head is 50 mm diameter and length of 228 mm.

A helical static mixer (having 3 elements; see FIG. 4) was used for layering the void sensitized emulsion into the void-free high density emulsion continuum. Alternating layers of void rich and void free are achieved by repeated division, transposition and recombination of liquid layers around a static mixer. Addition of further static mixer elements (for example No 4, 5 & 6) reduces the thickness of the layers produced.

Embodiments of the present invention are illustrated with reference to the following non-limiting examples.

EXAMPLE 2

In the absence of AN prill, bulk emulsion explosives rely on the inclusion of voids for sensitization. In such emulsions the oxidizer salt used is typically ammonium nitrate. When an ammonium nitrate emulsion (ANE) is sensitized with voids, for example by chemical gassing or by using micro-balloon (mb) inclusion, the void size is approximately 20-500 μm in diameter. When voids are used to sensitize such emulsion explosives they reduce the formulation density. However, homogeneous sensitization of emulsions with voids will result in much higher velocity of detonation (VOD) than corresponding formulations of a similar density containing AN prill.

This example details explosive compositions made up of two emulsion components: a non-sensitized ammonium nitrate emulsion (n-ANE) and a sensitized ammonium nitrate emulsion (s-ANE). The non-sensitized emulsion in this example has an ammonium nitrate concentration of approximately 75 wt % and a density of approximately 1.32 g/cc. The s-ANE has an ammonium nitrate concentration of approximately 75 wt % and a variable density from 0.8-1.2 g/cc using either chemical gassing or micro-balloons of a diameter of approximately 40 μm. Various explosive compositions in accordance with the invention can be formed by blending these emulsions and by adjusting the ratio of n-ANE:s-ANE in the formulation. As the ratio is adjusted from the extremes of 100% n-ANE to 100% s-ANE in a 200 mm diameter cardboard cylinder, the VOD ranges from a failure to detonate for the non-sensitized emulsion to over 6000 m/s for 100% s-ANE. However, the ability to isolate discrete regions of s-ANE (or n-ANE) within a bulk charge of n-ANE (or s-ANE) allows a geometric formulation variable to control detonation velocity and blasting characteristics between these extremes.

The method of manufacturing explosive compositions in accordance with the invention is based on blending two liquid energetic materials. The first phase is conventionally sensitized with voids, the second phase with no or very few added voids, the blending being such that the two phases remain largely distinct from each other, and the diameter, sheet thickness, etc. of the distinct phases are typically in the range from 0.2 mm to 100 mm.

Examples of Homogeneous s-ANE Charges

To identify how homogeneous s-ANE would perform without any n-ANE inclusions, a series of control charges were measured for VOD. The control shots contained ammonium nitrate emulsion and plastic Expancel micro-balloons of approximate 40 μm average diameter. The emulsion and micro-balloons were mixed to form a homogeneous blend ranging in density from 0.8 g/cc to 1.2 g/cc based on the amount of micro-balloons used. The VOD results can be seen in Table 1 below. A standard VOD measurement technique was used in which compositions were submitted for a detonation test in various unconfined diameters. Charges were detonated using Pentolite primers that were initiated with a No8 industrial strength detonator. The velocity of detonation (VOD) of the charges was measured by utilising a micro-timer unit and optical fibres.

TABLE 1

| Charge | | |
|---|---|---|
| Name | Density (g/cc) | VOD (km/s) |
| Control 0.8 | 0.8 | 4.5 |
| Control 0.9 | 0.9 | 5.0 |
| Control 1.0 | 1.0 | 5.6 |
| Control 1.1 | 1.1 | 6.0 |
| Control 1.2 | 1.2 | 6.3 |

As the density increased from 0.8 to 1.2 g/cc the VOD increased from 4.5-6.3 km/s. Clearly, the homogeneous sensitization of emulsion with 40 μm diameter voids produces an emulsion explosive of higher velocity of detonation at increasing densities as would be expected.

phase of s-ANE (emulsion+micro-balloons, density of 0.9 g/cc) occupying a total of 76.2% of the charge volume, and within this continuous phase are dispersed regions of n-ANE (density of 1.32 g/cc) which occupy the remaining 23.8% of the charge volume. For the purposes of laboratory testing these dispersed regions are in fact 120 ml cardboard cups filled with the n-ANE and placed randomly within the continuous emulsion, thus allowing a physical boundary for isolation of discrete emulsion phases. The combined density of the s-ANE and n-ANE in the charge was 1.0 g/cc. However, the VOD was found to be 4.9 km/s. This is a 13.2% reduction in VOD compared with control 1.0. Indeed, the VOD of charge M1.0, S0.9 is closer to the VOD of the Control 0.9 detailed above in Table 1 which is the same density as the continuous emulsion phase of this charge.

The charge labeled M1.0, S0.8 has an overall charge density of 1.0 g/cc, and a continuous s-ANE of 0.8 g/cc (61.5 vol %). Again, the charge has distributed cups (120 ml each) of n-ANE (38.5 vol %). The VOD of this charge was found to be 4.2 km/s, which is a 25% reduction in VOD compared to control 1.0. Once again the VOD for charge M1.0, S0.8 more closely matches the control shot at the same density as the continuous emulsion phase, i.e. Control 0.8 (Table 1) 4.5 km/s.

TABLE 2

| Charge | | Continuous Emulsion | | | Dispersed Emulsion | | | |
|---|---|---|---|---|---|---|---|---|
| Name | Density (g/cc) | Constituents | density (g/cc) | Vol % | Constituents | density (g/cc) | Vol % | VOD (km/s) |
| Control 1.0 | 1.0 | ANE + mb | 1.0 | 100 | | | | 5.6 |
| M1.0, S0.9 | 1.0 | ANE + mb | 0.9 | 76.2 | ANE | 1.32 | 23.9 | 4.9 |
| M1.0, S0.8 | 1.0 | ANE + mb | 0.8 | 61.4 | ANE | 1.32 | 38.5 | 4.2 |
| HANFO 1.0 | 1.0 | ANE + prill | 1.0 | 100 | | | | 3.6 |
| VG100 | 1.0 | ANE + EPS | 1.0 | 100 | | | | 3.6 |

In accordance with the present invention it is possible to reduce the VOD of these emulsion only explosives for each of the above densities, using the same size voidage, i.e. 40 μm diameter micro-balloons. To do this, regions of non-sensitized emulsion (n-ANE) were introduced into the sensitized emulsion to reduce the bulk VOD. The non-sensitized ammonium nitrate emulsion has a density of approximately 1.32 g/cc and consequently increases the overall density of the charge upon simple addition. Therefore to compare charges of equal density to the controls, sensitized emulsion (s-ANE) density must be sufficiently low that subsequent to n-ANE inclusion, the overall charge density is that desired.

Figure 5:
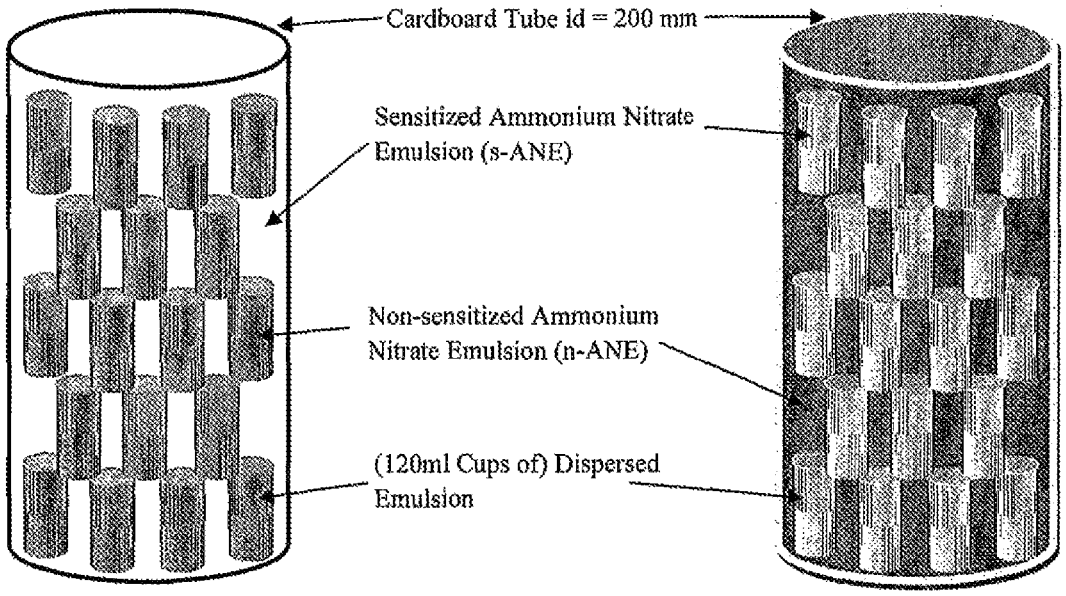
FIG. 5 is a schematic illustrating the distribution of two emulsions in an explosive composition in accordance with an embodiment of the invention.
Figure 6:
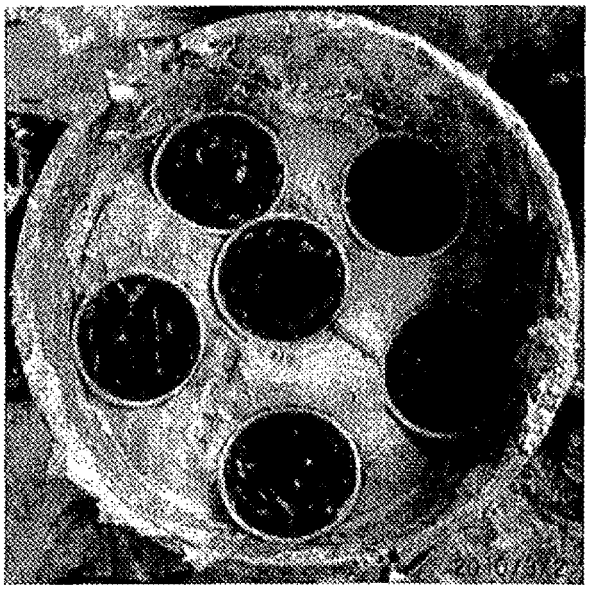

The experimental arrangement is shown schematically in FIG. 5 and by way of photograph (from above) in FIG. 6 where a continuous phase of s-ANE (light colour) has small 120 ml volume cups of n-ANE (dark colour) distributed within the charge. The s-ANE (0.8 g/cc) and the n-ANE (1.32 g/cc) combine to give a mixture of emulsions having a charge density of 1.0 g/cc. Shown in Table 2 below are the results of shots fired at this overall charge density. The first explosive composition is the control (as described above) consisting of only homogeneous phase of ammonium nitrate emulsion and Expancel micro-balloons. This explosive formulation had a VOD of 5.6 km/s.

The charge labeled M1.0, S0.9 in Table 2 below has an overall charge density of 1.0 g/cc, and contains two discrete emulsion phases as per the present invention. A continuous Also shown in Table 2 is the VOD for heavy ANFO (HANFO 1.0). This heavy ANFO is a homogeneous blend of emulsion (23 wt %) and ANFO (77 wt %), and as such does not have discrete continuous or dispersed emulsion phases as described for the mixtures of emulsion systems in accordance with the present invention. However, similar to the mixtures of emulsion and control 1.0 charges the heavy ANFO, HANFO 1.0, also has an overall charge density of 1.0 g/cc. Heavy ANFO charges rely on porous nitropril for sensitization, and the resulting VOD recorded was found to be 3.6 km/s. The last charge listed in Table 2 gives the results for VG100 which consists of emulsion (99.62 wt %) homogeneously mixed with expanded polystyrene (EPS, 0.38 wt %) of approximately 4 mm diameter for sensitization. As with heavy ANFO, the emulsion and expanded polystyrene are a homogeneous blend throughout the bulk charge and therefore have no discrete dispersed or continuous phases. The VOD for this product was found to be 3.6 km/s.

An important feature of the above charges is that the Control 1.0, M1.0, S0.9 and M1.0, S0.8 charges all have the same total quantity of emulsion and small 40 μm voids in the overall charges. Naturally, having equivalent formulation, they also have the same density, 1.0 g/cc. However, when the internal structure of the explosive charge contains two distinct phases of s-ANE and n-ANE, the VOD of the charge is reduced from the homogeneously mixed analogue such as Control 1.0. One important aspect of the invention is that emulsion only explosives utilizing small 40 μm voids can be formulated to have VOD characteristics of prill and EPS containing products.

Mixture of Emulsion (MOE) Charges of Overall Density 1.1 g/cc

As shown in Table 3 below, all charges have an overall density of 1.1 g/cc. The Control 1.1 was a single phase of s-ANE having a density of 1.1 g/cc. The VOD of this control shot was found to be 6.0 km/s. The charge labeled M1.1, S1.0 has a continuous s-ANE phase of density 1.0 g/cc occupying 68.4% of the total charge volume. The remaining volume of the charge was made up of n-ANE in 120 ml cups distributed throughout the charge. The VOD for charge M1.1, S1.0 was found to be 5.1 km/s. Similarly, charge M1.1, S0.9 was made up of a continuous emulsion phase of s-ANE having a density of 0.9 g/cc occupying 52.4% of the total charge volume and distributed therein 120 ml cups of n-ANE accounting for the remaining 47.6% of total charge volume. Charge M1.1, S0.9 was found to have a VOD of 4.6 km/s.

Charge M1.1, S0.8 was the first charge loaded with n-ANE as the continuous emulsion phase. Therefore, charge M1.1, S0.8 has non-sensitized continuous emulsion phase accounting for 58.8% of the total charge volume. Distributed within this charge was s-ANE having a density of 0.8 g/cc contained in 120 ml cups and accounting for the remaining 41.2 vol % of the total charge. The VOD for charge M1.1, S0.8 was found to be 3.2 km/s. This is a significant reduction to Control 1.1 charge. In addition this low VOD is also lower than heavy ANFO charge HANFO 1.1, thus confirming that mixtures of emulsions in accordance with the invention can achieve low detonation velocities down to levels not previously achievable by small 20-100 μm diameter voids, and comparable to nitropril containing emulsion products.

TABLE 3

| Charge | | Continuous Emulsion | | | Dispersed Emulsion | | | |
|---|---|---|---|---|---|---|---|---|
| Name | Density (g/cc) | Constituents | density (g/cc) | Vol % | Constituents | density (g/cc) | Vol % | VOD (km/s) |
| Control 1.1 | 1.1 | ANE + mb | 1.1 | 100 | | | | 6.0 |
| M1.1, S1.0 | 1.1 | ANE + mb | 1 | 68.4 | ANE | 1.32 | 31.6 | 5.1 |
| M1.1, S0.9 | 1.1 | ANE + mb | 0.9 | 52.4 | ANE | 1.32 | 47.6 | 4.6 |
| M1.1, S0.8 | 1.1 | ANE | 1.32 | 58.8 | ANE + mb | 0.8 | 41.2 | 3.2 |
| HANFO 1.1 | 1.1 | ANE + prill | 1.1 | 100 | | | | 3.8 |

Mixture of Emulsion (MOE) Charges of Overall Density 1.2 g/cc

A series of charges all having an overall density of 1.2 g/cc is detailed in Table 4 below. The control charge was a homogenous blend of ammonium nitrate emulsion and micro-balloons of density 1.2 g/cc, and having a VOD of 6.3 km/s. The remaining charges detailed in Table 4 had a continuous emulsion phase of n-ANE. Charge M1.2, S1.0 had a continuous n-ANE phase accounting for 63.9% of the total charge volume. The s-ANE used had a density of 1.0 g/cc and was distributed within the n-ANE in 120 ml cups occupying remaining 36.1% of the total charge volume. Charge M1.2, S1.0 had a measured VOD of 4.3 km/s.

Charge M1.2, S0.9 included a continuous emulsion phase of n-ANE. This accounted for 73.1 vol % of the total charge. The remaining 26.9 vol % was made up of a s-ANE of density 0.9 g/cc. M1.2, S0.9 had a VOD of only 2.3 km/s. This low VOD could be close to failure as a consequence of such a high volume of n-ANE. Indeed M1.2, S0.8 with 78.0 vol % of n-ANE failed to initiate and over half of the test charge remained after attempted initiation with a 400 g Pentolite booster.

TABLE 4

| Charge | | Continuous Emulsion | | | Dispersed Emulsion | | | |
|---|---|---|---|---|---|---|---|---|
| Name | Density (g/cc) | Constituents | density (g/cc) | Vol % | Constituents | density (g/cc) | Vol % | VOD (km/s) |
| Control 1.2 | 1.2 | ANE + mb | 1.2 | 100 | | | | 6.3 |
| M1.2, S1.0 | 1.2 | ANE | 1.32 | 63.9 | ANE + mb | 1 | 36.1 | 4.3 |
| M1.2, S0.9 | 1.2 | ANE | 1.32 | 73.1 | ANE + mb | 0.9 | 26.9 | 2.3 |
| M1.2, S0.8 | 1.2 | ANE | 1.32 | 78.0 | ANE + mb | 0.8 | 22.0 | FAIL |
| HANFO 1.2 | 1.2 | ANE + prill | 1.2 | 100 | | | | 4.0 |

Although not experimentally measured, there are clearly opportunities to incorporate solid oxidizers, such as AN prill, in one or both of the phases to further fine tune the total energy available and the heave energy/shock energy balance. There are also clearly opportunities to incorporate sub-mm energetic solid fuels, such as aluminum, in one or both of the phases to further significantly enhance the heave energy while achieving exceptionally low shock energies.

EXAMPLE 3

Gassed Emulsion at 1.22 g/cm$^3$

This example serves as a baseline to demonstrate the features of the invention.

Experimental samples were prepared in a specially designed emulsion experimental rig. The corresponding process diagram is shown in FIG. 3. With reference to that figure the experimental rig comprises two emulsion holding hoppers ANE1 and ANE2. Two metering pumps PC Pump 1 and PC Pump 2 supply streams of the emulsions into an inter-changeable mixing head. The mass flow of the individual fluid streams is set up by calibration of the metering pumps and cross-checking against the total mass flow via into the inter-changeable mixing head. Blending is done in a continuous manner in the closed pipe of a interchangeable mixing head module.

The inter-changeable mixing head is comprised of two parts. The first part has two separate inlet channels for the entry of each emulsion stream and a baffle just before the entrance to the first static mixer element to ensure separation of the individual streams in the mixing section. The inter-changeable mixing head is 50 mm diameter and length of 228 mm.

A Kenics static mixer (having 3 elements; see FIG. 4) was used for layering the void sensitized emulsion into the void-free high density emulsion. Alternating layers of void rich and void free emulsions are achieved by repeated division, transposition and recombination of liquid layers around a static mixer. In this way, the components of emulsion to be mixed are spread into a large number of layers. A clearly defined and uniform shear field is generated through mixing. Addition of further static mixer elements (for example No 4, 5 & 6) reduces the thickness of the layers produced.

The starting emulsion at a density of 1.32 g/cm$^3$ was delivered by a progressive cavity pump at a rate of 3 kg/min. A 4% mass sodium nitrite solution was injected into the flowing emulsion stream at a rate of 16 g/min by means of a gasser (gear) pump and dispersed in a series of static mixers. 1 m long cardboard tubes with internal diameters ranging from 40 to 180 mm were loaded with emulsion and allowed to gas.

The density change of the gassing emulsion was determined in a plastic cup of known mass and volume. The emulsion was initially filled to the top of the cup and leveled off. As the gassing reaction progressed, the emulsion rose out of the top of the cup and was leveled off periodically and weighed. The density was determined by dividing the mass of emulsion in the cup by the cup volume. Charges were fired once the sample cup reached the target density of 1.22 g/cm$^3$.

Charges larger than 70 mm were initiated with a single 400 g Pentex PPP booster, whist smaller charges were initiated with a 150 g Pentex H booster. Velocity of detonation (VOD) was determined using an MREL Handitrap VOD recorder. The VOD ranged from 2.9 km/s for the 70 mm diameter charge to 4.3 km/s at 180 mm. Charges smaller than 70 mm failed to sustain detonation. The results are shown in FIG. 7.

EXAMPLE 4

MOE 25 at 1.22 g/cm$^3$

This example demonstrates the performance of MOE25, i.e. a mixture of emulsion with 25% mass gassed and 75% ungassed emulsion.

MOE25 was prepared using the apparatus mentioned in Example 3. The base emulsion (density 1.32 g/cm$^3$) was delivered by two progressive cavity pumps, PC1 and PC2. The base emulsion formulation was identical to Example 3 and was the same for both pumps. PC1 pumped ungassed emulsion at a flow rate of 4 kg/min. PC2 delivered emulsion at 1.3 kg/min with gasser (4% $NaNO_2$ solution) injected by a gasser (gear) pump. The emulsion was blended by a static mixer consisting of three helical mixing elements and loaded into cardboard tubes with internal diameters ranging from 70 to 180 mm. The gassed emulsion target density was 0.99 g/cm$^3$ providing an overall density of 1.22 g/cm$^3$ for the mixture of gassed and ungassed emulsion.

Charges were initiated with a single 400 g Pentex PPP booster with VOD measured with an MREL handitrap VOD recorder. The VOD ranged from 2.5 km/s for the 90 mm charge to 3.7 km/s at 180 mm, a significant reduction relative to the regular gassed emulsion described in Example 3. Charges with diameters smaller than 90 mm failed to sustain detonation. The results are shown in FIG. 8. The reduced VOD of MOE25 indicates that this formulation, comprising a mixture of void rich and void deficient materials, exhibits a lower shock energy and higher heave energy relative to regular gassed emulsion containing randomly dispersed voids at the same overall density.

EXAMPLE 5

MOE 50 at 1.22 g/cm$^3$

This example demonstrates the performance of MOE50, i.e. a mixture of emulsion with 50% mass gassed and 50% ungassed emulsion.

MOE50 was prepared using the apparatus mentioned in Example 3. The base emulsion (density 1.32 g/cm$^3$) was delivered by two progressive cavity pumps, PC1 and PC2 and was identical to the previous two examples. PC1 pumped ungassed emulsion at a flow rate of 3 kg/min. PC2 delivered emulsion at 3 kg/min with gasser (4% $NaNO_2$ solution) injected by a gasser (gear) pump. The void rich and void free emulsions were blended by a static mixer consisting of three helical mixing elements and loaded into cardboard tubes with internal diameters ranging from 70 to 180 mm. The gassed emulsion target density was 1.13 g/cm$^3$ providing an overall density of 1.22 g/cm$^3$ for the mixture of gassed and ungassed emulsion.

Charges were initiated with a single 400 g Pentex PPP booster with VOD measured with an MREL handitrap VOD recorder. The VOD ranged from 2.8 km/s for the 80 mm charge to 3.9 km/s at 180 mm. Charges with diameters smaller than 80 mm failed to sustain detonation. The results are shown in FIG. 9. VOD results for MOE50 were between those of gassed emulsion and MOE25, indicating intermediate shock and heave energies. This demonstrates that explosive performance can be tailored to suit different blasting applications by adjusting the proportion of void rich and void deficient materials at the same overall density.

PCT/AU2012/001528

The following information is taken from the disclosure of PCT/AU2012/001528. This information should be read in this context. For example, in this section when reference is made to "the invention" or "the present invention", this is a reference to the invention described in PCT/AU2012/001528.

SUMMARY OF THE INVENTION OF PCT/AU2012/001528

The present invention focuses on void-sensitized liquid energetic materials, such as emulsion explosives. This type of explosive formulation is well known and commonly used in the art. Emulsion explosives include voids distributed in a liquid energetic material, the voids rendering the explosive detonable. The voids may be in the form of gas bubbles, glass microballoons, plastic microballoons, expanded polystyrene spheres, and indeed any cavities that produce a low density region in the liquid explosive. For commercial mining explosives the average mean diameter of the voids can range from 25 microns to 500 microns. The lower end of void size is limited by the need for the void to act as an ignition point in the explosive and the upper end is limited by the need for the explosive to fully react. Preferably, an optimum voidage is incorporated in order to achieve satisfactory detonation propagation in terms of a critical diameter of the explosive charge and critical velocity of detonation. By using the minimum amount of voids it is possible to retain relatively high density of the resultant composition.

Typically, the total volume (voidage) occupied by the voids in the composition is at least 3% based on the total volume of the composition. Usually, the total volume of the voids is at least 10% by volume, for instance up to about 20% by volume. Inclusion of an amount of voids (or cavities) over and above the critical amount required for sensitization will unnecessarily reduce the density of the composition and lead to reduced energy-density of the resultant explosive material.

In the context of the present invention sensitizing voids may be gas bubbles, glass microballoons, plastic microballoons, expanded polystyrene beads, or any other material with a density below 0.25, with the voids having a mean diameter in the range 20 to 2000, preferably in the range 40 to 500 microns.

In accordance with the present invention it has been found that this type of explosive composition possesses structural features that can readily be tailored to influence detonation characteristics. The present invention provides a new way of defining the structure of an explosive material that comprises sensitizing voids distributed in a continuum of liquid energetic material. Specifically, in accordance with the present invention it has been found that the structure can be represented by a statistical/mathematical model. Moreover, it has been found that this model can be related to the bulk detonation properties of the explosive materials in terms of detonation and burning reactions. These reactions are related to the energy release profile associated with explosive materials in terms of the partitioning between shock and heave energies. Shock energy is related to detonation reactions and heave energy is related to (the efficiency of) burning reactions. This approach can be applied to characterize the structure and to understand the detonation behavior of known void sensitized liquid energetic materials. It may also be applied to characterize the structure and to understand/predict the detonation behavior of newly designed and formulated void sensitized liquid energetic materials.

In accordance with an embodiment of the invention it is possible to relate desirable bulk detonation properties of this type of explosives material to a statistical/mathematical model that represents the distribution of sensitizing voids within a (continuum of) liquid energetic material, and from that model to derive structural templates (in terms of void distribution) that will yield those detonation properties. This embodiment may therefore be regarded as a design tool for the formulation of void-sensitized liquid energetic materials.

The present invention uses what is referred to herein as a "distribution function" (DF) to characterize an explosives material in terms of its internal structure with respect to the distribution of sensitizing voids within a (continuum of) liquid energetic material. The "distribution function" (DF) is the fraction of liquid energetic material that is within a given distance from any void surface. Accordingly, in one embodiment the present invention provides a method of characterising the structure of a void sensitized liquid energetic material, which comprises determining for the material (defining the material in terms of) the fraction of liquid energetic material that occurs at a given distance from any void surface within the void sensitized liquid energetic material. This determination results in a distribution function template for the void-sensitized liquid energetic material. The distribution functions are believed to be new per se and the invention also relates to them as such.

Those skilled in the an of statistical mechanics may see similarities between the distribution function as used in the present invention and the concept of radial distribution function (DF) or pair correlation function that has been applied to describe how the atomic density in a material varies as a function of the distance from a particular atom. One of the uses of the radial distribution function is in providing mathematical relationships that define thermodynamic properties of a material in terms of the positions of atoms in that material.

As will be explained, the bulk detonation energy output for a void-sensitized liquid energetic material can be related to the DF template of the material. Accordingly, in another embodiment the present invention provides a method of achieving a designed bulk detonation energy output in an explosives material comprising sensitizing voids distributed within a liquid energetic material, which method comprises determining a distribution function template that is representative of the designed detonation energy output for the explosives material and formulating an explosive material consistent with that distribution function template by suitable placement and distribution of sensitizing voids within a liquid energetic material. In an embodiment of the invention this may be done by suitable combination of a void-sensitized liquid energetic material with a void-free liquid energetic material. In accordance with the present invention it has been found that structure and detonation properties of the resultant composition is related to the volume ratio of each energetic liquid and the structural arrangement of the energetic liquids relative to each other.

In this embodiment the internal structure of the explosive composition is such that the two energetic materials are present as discrete regions. These regions may be distributed uniformly or randomly throughout the composition. The volume proportion, size and spatial arrangement of the regions define the bulk explosive structure. It has been found that the nature of the energetic liquids used and the bulk structure of the resultant explosive composition influences the energy release characteristics of the explosive composition. Thus, the voids, after their reaction determine amount of shock energy and the regions of void-free liquid energetic material determine the heave energy. Quantitatively, the amount of shock energy is a function of the "total voidage volume" and the amount of heave energy is a function of the void-free component volume fraction.

Importantly, this embodiment allows the energy release characteristics of an explosive composition to be understood and controlled by varying the combination of energetic liquids used and/or the arrangement of the energetic liquids within the bulk of the explosive composition. In turn this enables the detonation properties of the explosive composition to be tailored to particular rock/ground types and to particular mining applications.

While this invention is concerned with the design of liquid explosives, and the detonation performance is determined by the distribution of the voids in the liquid, this does not preclude the addition of small quantities of energetic solids such as aluminium and/or ammonium nitrate prills to further modify the detonation performance.

The present invention also relates to the design of new liquid explosive compositions with novel geometrical distributions of sensitizing voids. A method of mathematically characterizing the internal structure of these explosive compositions is presented. Also an empirical relationship between the internal structure and the bulk detonation properties has been found. A particular advantage of these liquid explosives is the higher energy densities and much higher heave energies that are achievable compared with conventional liquid explosives.

Throughout this specification and the claims which follow, unless the context requires otherwise, the word "comprise", and variations such as "comprises" and "comprising", will be understood to imply the inclusion of a stated integer or step or group of integers or steps but not the exclusion of any other integer or step or group of integers or steps.

The reference in this specification to any prior publication (or information derived from it), or to any matter which is known, is not, and should not be taken as an acknowledgment or admission or any form of suggestion that that prior publication (or information derived from it) or known matter forms part of the common general knowledge in the field of endeavour to which this specification relates.

DETAILED DISCUSSION OF THE INVENTION OF PCT/AU2012/001528

As noted above, in the context of the present specification, the distribution function (DF) for a void-sensitized liquid energetic material is a statistical representation of the fraction of liquid energetic material that is within a given distance from any void surface. This can be illustrated with reference to FIG. 10 below. FIG. 10 shows DF templates that are representative of conventional emulsion explosives in which a liquid energetic material is sensitized by the inclusion of voids. The voids have a random distribution in the liquid energetic material.

In FIG. 10 the y-axis is the fraction of liquid energetic material within a distance "r" from any void surface and the x-axis represents the radial distance from the nearest void surface. The solid line, DF0 template, represents a theoretical emulsion in which the voids are at the centers of an array of 50 micron cubes, and "r" is the distance from the nearest void surface. The dotted line, DF1 template, represents a conventional emulsion of the same density as the cubic array, but with a random distribution of the voids, 95% having separations between 35 to 60 microns (a random generator picks positions in a 50 micron cubic grid so that voids can be placed randomly in the grid until the target voidage (density) is reached). This random distribution of voids is consistent with what one would observe in conventional emulsion explosives that are formulated by distributing sensitizing voids within a liquid energetic material.

In practice, the randomness of the distribution of the voids will depend on the mixing procedure used, and the corresponding DF may vary from the DF1 template slightly. Nevertheless, it is believed that such changes would not be dramatic; the curve would still be sigmoid in nature and there would be no abrupt changes in the slope of the curve. In relation to such conventional void-sensitized liquid energetic materials the present invention resides in the application of DF to describe/represent the internal structure of the material. The application of statistical modeling involving DF to explosives is unique in this regard.

The present invention is also concerned however with characterizing the internal structure of explosives materials that are new with respect to how voids are distributed within a liquid energetic material, and to the corresponding DF templates associated with such new explosives materials. Noting the random manner in which voids are present in conventional void-sensitized explosive materials, in general terms this new internal structure may be described as involving a non-random (or designed) distribution of voids. In view of this fundamental difference in void distribution, these new explosive materials will have different DF templates when compared with the DF templates associated with conventional materials.

This embodiment of the present invention may be illustrated with reference to unique forms of explosive formulation that have a non-random distribution of voids in a liquid energetic material. Specifically, this explosive is manufactured by blending a void-free energetic liquid with conventional void sensitized energetic liquid. These formulations are referred to as mixtures of emulsion, designated MoE. Careful blending is undertaken to ensure that the finished formulation includes discrete regions of the individual component liquid energetic materials. The explosive can be conveniently prepared by laminar mixing of streams of the individual components using a static mixer (see for example FIG. 16 and the accompanying discussion). By this mixing methodology the streams of the individual components are split into sheets that have a mean thickness typically in the range 0.2 to 50 mm. It is to be understood however that sheets of larger thicknesses could be employed without deviating from the spirit of the invention. The characteristics of the sheets can be adjusted by adjusting the mixing methodology, for example by varying the number of mixing elements in the static mixer. DF templates for a number of formulations with varying dimensions of the void-free regions of liquid energetic material were modeled using the DF procedure described above. FIG. 11 is a plot as per FIG. 10 showing how the DF varies for each formulation.

In Relation to FIG. 11:

- Template (DF0) and Template (DF1) are the same as in FIG. 1, and correspond to the theoretical and conventional void-sensitized emulsions.
- Template (DF2) relates to a 50:50 blend of the conventional void sensitized emulsion and void-free emulsion in which the regions of void-free emulsion have dimensions ranging from 2 to 4 times the diameter of the voids in the sensitized emulsion.
- Template (DF3) relates to a 50:50 blend of the conventional void sensitized emulsion and an void-free emulsion in which the regions of void-free emulsion have dimensions ranging from 3 to 6 times the diameter of the voids in the sensitized emulsion.
- Template (DF4) relates to another equal blend of the conventional void-sensitized emulsion and an void-free emulsion, but in this case the regions of void-free emulsion have dimensions ranging from 4 to 8 times the diameter of the voids in the sensitized emulsion.
- Template (DF6) exhibits simply a coarser blend of sensitized and void-free emulsions in which the regions of void-free emulsion have dimensions ranging from 6 to 10 times the diameter of the voids in the sensitized emulsion.

It will be noted that the formulations in which the voids are provided with a non-random (designed) distribution give rise to DFs that have increasingly different shapes from those for conventional emulsions, i.e. DF0 and DF1 . For formulations having a non-random void distribution, the plot of DF against radial distance (r) departs from that of conventional formulations with this departure becoming more exaggerated as the dimensions of the void-free emulsion increases.

For DF2, DF3, DF4 and DF6 the exact shape of the curve will vary depending on such factors as the voidage level of the sensitized emulsion and the void distribution of that emulsion.

An alternative method of displaying the differences between DFs for the conventional and non-random void sensitized formulations is to plot the differential of the DF with respect to the distance from the nearest void surface "r", against the "DF". This produces a graph that is similar in form to the conventional way of displaying reaction kinetics in the modelling of detonation. In this the reaction rate is plotted against the fraction of material reacted.

Such a DF rate plot is shown in FIG. 12 where the y-axis is the rate of change of the distribution function from the nearest void surface ("r") (DF rate) and the x-axis is the unity normalized distribution function.

In Relation to FIG. 12:

- Template (DF0) and Template (DF1) correspond to the theoretical and conventional emulsion blends as shown in FIG. 1.
- DFa3, DFa5, DFa8 and DFa14 are 50:50 blends of a conventional emulsion and an unsensitized emulsion in which the conventional emulsion is distributed as droplets/globules in a continuum of the unsensitized emulsion, the diameters of the droplets/globules being approximately 3, 5, 8 and 14 times the average diameter of the voids.

Various Aspects are Worthy of Comment:

- The first point to notice with this method of displaying information is the "dome" shape of the distribution function curves.
- For the conventional emulsions the "dome" is more or less symmetrical, remaining convex over "DF" values (x-axis) from 0 to 1. However, this is not the case for the non-conventional formulations, where the domed portion of the curve extends approximately only from "DF" values (x-axis) 0 to 0.5, after which the curve has a point of inflexion and transitions to a concave shape. It will be shown later that emulsions that exhibit this characteristic point of inflexion and concave shape in their DF curve exhibit reduced VODs relative to conventional emulsions with symmetrical, convex DF curves.
- For the non-conventional formulations the maximum value of DF rate over the DF range from 0 to 1 is significantly less than for the conventional formulations.
- The non-conventional formulations exhibit increasingly lower values of "DF rate" (y-axis) and reduced slope gradient at values of "DF" above 0.5. This is the consequence of distance between Cr) the sensitizing voids becoming greater.
- The emulsions prepared by conventional methods exhibit comparable "DF rate" of non-conventional materials only at DF values between 0.85 and 1.0.
- The DF rate templates for the non-conventional formulations correspond to emulsion blend ratios of sensitized to dense emulsions from 10% to 90%, which roughly correspond to the transition from the "dome" region to the lower "DF rate" region occurring at "DF" values between 10% and 85%.

Experimental measurements of the distribution functions (DFs) of conventional emulsions (random distribution of voids) were carried out using an X-ray tomography method to record the positions and sizes of voids in a 10 mm×10 mm×1 mm sample of a gassed emulsion. The two dimensional digital record of this was analyzed using commercial image analysis software that identified the outer edges of all the voids, and provided a digital output of the coordinates of the centre and length of the circumference of each void. This data was then used to generate templates for the "DF rate" plots. An X-ray tomography image and analysis of a conventional gas-void emulsion is shown in FIG. 413. The circumference of lighter of the voids is analysed, noting also that certain features were identified as ammonium nitrate crystals where the emulsion has broken down.

The data from this two dimensional analysis was also used to generate "DF rate" graphs. This was done by calculating the distance of each pixel of the digital image that corresponds to emulsion, from the nearest void surface, a computationally intensive operation. The resultant graph of the experimental DF is shown in FIG. 14. FIG. 14 is a representation of distribution function rate (DF rate) for the experimental X-ray image analysis of the experimental data.

- DFex is the experimental data for a conventional emulsion in which voids cover about 20% of the area, the traces therefore stopping below this value on the x-axis.
- DFsim is a simulated conventional emulsion in which the void size distribution and average void concentration is set approximately equal to that of the experimental data.

It will be noted that DFex and DFsim in FIG. 14 exhibit a convex shape consistent with the convex shape of plots for DF0 and DF1 in FIG. 12.

From the foregoing it should be apparent how to generate DF profile templates for void sensitized formulations. The approach may be especially useful for generating DF templates for non-conventional formulations that are typically prepared by blending a conventional void sensitized emulsion with a void-free (or differently sensitized) continuum of liquid energetic material.

FIG. 15 shows a plot of velocity of detonation (VOD) divided by ideal VOD versus inverse diameter, where the ideal VOD is calculated by application of hydrodynamic theory, for example the Orica Ltd program IDEX. The figure plots results for two conventional explosive formulations and one non-conventional explosive formulation for charge diameters in range between 40-300 mm.

The conventional charges were samples of AN-based emulsion explosives prepared by a conventional methodology at densities equal to 1.22 and 1.02 g/cm$^3$ for EM 100 both exhibiting a random distribution of sensitizing voids. The total sensitizing voids volume was equal to about 5.3% for EM 100 at 1.22 g/cm$^3$ and 23% for EM 100 of the AN-based liquid energetic material continuum. The latter was the same for both formulations. With regard to VOD data the solid lines in FIG. 15 are fits to a theoretical model of non-ideal detonation.

The main point to note from this experiment is that the emulsion prepared by a conventional method as per DFsim/DFex templates exhibits an approximately straight line relationship of VOD/idealVOD against inverse diameter. The DF rate profiles for these conventional formulations are reasonably matched to be in line with the DFsim/DFex template in FIG. 14 above.

A non-conventional emulsion explosive formulation (denoted MOE 25) was prepared according to a selected DF rate design template produced in accordance with the present invention. The non-conventional formulation was a blend of 25% mass void sensitized liquid energetic material (density 1.02 g/cc) and 75% mass void-free liquid energetic material continuum (density 1.32 g/cc). The liquid energetic material used was the same as used in formulating the conventional EM 100 control samples. The resulting explosive charges of MOE 25 had a density of 1.23 g/cc.

Experimental samples were prepared in a specially designed emulsion experimental rig shown in FIG. 16 and described in Example 6.

Notably, the relationship between VOD against inverse diameter for this non-conventional formulation was very different from that of the conventional control sample. Indeed, considering that the liquid energetic material continuum used is identical, it is remarkable to see the vast difference between the VOD characteristics for these formulations.

More importantly, the non-conventional formulation shows a characteristic highly concave variation of unconfined normalised detonation velocity (VOD/idealVOD) versus inverse diameter. In contrast, the formulations prepared by conventional methodology exhibit an approximately straight or slightly concave shape from the critical diameter to the ideal VOD.

It is well known to those skilled in the art that at a given explosive density, the shock energy increases with increasing VOD, and that a reduction in VOD corresponds to an increase in heave energy.

For a given liquid energetic material, it is important to note that lower VODs can be obtained in conventional formulations by reducing density, i.e. by increasing the level of voidage include in the liquid energetic material. However, an undesirable effect of this is reduced energy density output and thus lower heave and shock energy.

In distinct contrast, the formulation provided in the present invention enables reduced VOD to be achieved without reducing overall energy density. Thus, such non-conventional formulations may provide a remarkable enhancement in energy density as well as enhanced and unique partitioning of heave energy to shock energy.

In practice implementation of the design aspect of the present invention is likely to involve the following sequence of steps, given by way of illustration with reference to a particular example:

1. Select the density of the void-free liquid energetic material being used and the desired density of the high energy density/high heave charge to be formulated. For example, the density of the void-free liquid energetic material may be 1.32 g/cc and the required density of the explosive charge to be produced is 1.23 g/cc.
2. Calculate the total volume of the voidage that needs to be incorporated to achieve the required density. Calculated voidage volume is (100)−(1.23/1.32×100)=6.8%. Note: this is not necessary for gas sensitized emulsions. However, it is helpful in case of micro-balloons as sensitizing agent or other material voids when the particle density is known. The required mass of balloons to achieve voidage-density can be then calculated.
3. Select the mean size of the voids to be used for sensitization. For example, the mean size of the voids might be 150 μm. (Measure the size distribution if desired).
4. Select the DF template to obtain desirable VOD (shock/heave ratio), for example, the DF4 template. This template represents 50/50 volume fine blend of conventional
5. Calculate the required density of sensitized energetic material that gives the final density of 1.23 g/cc when mixed 50/50 with void-free liquid energetic material, i.e. 1.14 g/cc.
6. Blend 50% sensitized conventional liquid energetic material (density of 1.14 g/cc) and 50% void-free liquid energetic material (density of 1.32 g/cc) utilizing process consistent with achieving the DF4 template.
7. The DF4 template requires the high density regions to have dimensions equal to 4-8 times the diameter of the voids. Calculate the size of the dense emulsion regions as (150 μm×4)=600 μm and (150 μm×8)=1200 μm.
8. Select the "static mixer blending head" with laminar flow design such that individual streams of sensitized and void-free components are provided within the thickness specified by DF4 template. This is 600-1200 μm.

Embodiments of the present invention are illustrated with reference to the following non-limiting examples.

EXAMPLES

Description of Equipment

Experimental samples were prepared in a specially designed emulsion experimental rig. The corresponding process diagram is shown in FIG. 16. With reference to that figure the experimental rig comprises two emulsion holding hoppers ANE1 and ANE2. Two metering pumps PC Pump 1 and PC Pump 2 supply streams of the emulsions into an inter-changeable mixing head. The mass flow of the individual fluid streams is set up by calibration of the metering pumps and cross-checking against the total mass flow via into the inter-changeable mixing head. Blending is done in a continuous manner in the closed pipe of a interchangeable mixing head module.

The inter-changeable mixing head is comprised of two parts. The first part has two separate inlet channels for the entry of each emulsion stream and a baffle just before the entrance to the first static mixer element to ensure separation of the individual streams in the mixing section. The inter-changeable mixing head is 50 mm diameter and length of 228 mm.

A Kenics static mixer (having 3 elements; see FIG. 17) was used for layering the void sensitized emulsion into the void-free high density emulsion continuum through laminar flow of two continuous streams of the emulsions. Laminar mixing is achieved by repeated division, transposition and recombination of liquid layers around a static mixer. In this way, the components of emulsion to be mixed are spread into a large number of layers. A clearly defined and uniform shear field is generated through mixing. Addition of further static mixer elements (for example No 4, 5 & 6) reduces the thickness of the layers produced.

The density change of the gassing emulsion was determined in a plastic cup of known mass and volume. The emulsion was initially filled to the top of the cup and leveled off. As the gassing reaction progressed, the emulsion rose out of the top of the cup and was leveled off periodically and weighed. The density was determined by dividing the mass of emulsion in the cup by the cup volume. Charges larger than 70 mm in diameter were initiated with a single 400 g Pentex PPP booster, whist smaller charges were initiated with a 150 g Pentex H booster. Velocity of detonation (VOD) was determined using an MREL Handitrap VOD recorder.

Procedure for Determining Distribution Function

Product samples were delivered from the pump rig described above into a 100 mm diameter cylindrical plastic container consisting of a 150 mm tall base, a 10 mm sample slice and a 30 mm tall top slice, as shown in FIG. 21. The three slices were joined together with masking tape to produce a cylinder which was filled to the top with emulsion. After filling, the upper 30 mm slice was removed and the emulsion scraped level on the top of the 10 mm slice with a flat stiff blade. A clear perspex plate was placed over the top of the 10 mm slice, and the entire container inverted. The 150 mm section was then removed, leaving the 10 mm section filled with emulsion sitting on the flat perspex plate. The emulsion was allowed to gas to completion prior to photography. The slice was illuminated from underneath using an x-ray viewer and photographed from above with a digital camera.

The photograph of the product structure was analysed using the ImageJ program. A rectangular section of the image was selected for distribution function analysis. FIG. 13 shows a typical image after processing and the rectangular section selected for DF analysis. The software enabled automatic detection of the bubbles in the photograph and produced a table showing the x and y position of the voids, the void perimeters and the void area. This data was exported to Mathcad for radial distribution function analysis.

The distribution function (DF) plots the fraction of emulsion that is within a given distance of a void surface. The DF procedure involved calculating the distance from each emulsion pixel to the nearest bubble surface. This program calculated the distance between a pixel and all of the bubble surfaces and returned the distance to the nearest bubble surface. The procedure was then repeated for all emulsion pixels. The frequency of emulsion points residing within a given distance to a bubble surface was then determined and plotted as a cumulative distribution. The differential of the cumulative fraction with respect to distance was also plotted against the cumulative fraction (also referred to as distribution function rate).

Example 6

Gassed emulsion at 1.22 g/cm$^3$

This example demonstrates the performance of conventional gassed emulsion with random void distribution at a density of 1.22 g/cm$^3$.

The starting emulsion at a density of 1.32 g/cm$^3$ was delivered by a progressive cavity pump at a rate of 3 kg/min. A 4%/0 mass sodium nitrite solution was injected into the flowing emulsion stream at a rate of 16 g/min by means of a gasser (gear) pump and dispersed in a series of static mixers. 1 m long cardboard tubes with internal diameters ranging from 40 to 180 mm were loaded with emulsion and allowed to gas. Charges were fired once the sample cup reached the target density of 1.22 g/cm$^3$.

A sample of the emulsion was taken for DF analysis according to the procedure described above. FIG. 25 shows the void positions for conventional gassed emulsion. The cumulative distribution function is plotted in FIG. 26 and the differential plotted in FIG. 18. The cumulative distribution function shows a steep curve, with the cumulative fraction rising to unity within a distance of approximately 0.7 mm. This indicates that 100% of the emulsion in the sample lies within 0.7 mm of a void surface. The differential of the distribution function (FIG. 27) shows a characteristic convex shape.

The VOD ranged from 2.9 km/s for the 70 mm diameter charge to 4.3 km/s at 180 mm. Charges smaller than 70 mm failed to sustain detonation. The VOD results are illustrated in FIG. 18.

Example 7

MOE 25 at 1.22 g/cm$^3$

This example demonstrates the performance of MOE25, i.e. a mixture of emulsion with 25% mass sensitized and 75% unsensitized emulsion and was prepared using the apparatus described above.

The base emulsion (density 1.32 g/cm$^3$) was delivered by two progressive cavity pumps, PC1 and PC2. The base emulsion formulation was identical to Example 6 and was the same for both pumps. PC1 pumped ungassed emulsion at a flow rate of 4 kg/min. PC2 delivered emulsion at 1.3 kg/min with gasser (4% $NaNO_2$ solution) injected by a gasser (gear) pump. The emulsion was blended by a static mixer consisting of three helical mixing elements and loaded into cardboard tubes with internal diameters ranging from 70 to 180 mm. The gassed emulsion target density was 0.99 g/cm$^3$ providing an overall density of 1.22 g/cm$^3$ for the mixture of gassed and ungassed emulsion.

A sample of the emulsion was taken for DF analysis according to the procedure described above. The void positions in this sample are shown in FIG. 24. The cumulative distribution function is plotted in FIG. 26 and the differential plotted in FIG. 27. Compared to the gassed emulsion curve, the cumulative distribution for MOE 25 exhibits a significantly shallower slope, with a long tail that extends out to a distance of approximately 6 mm. The plot of the distribution function differential can also be distinguished from the gassed emulsion sample by the presence of a point of inflexion in the curve and a concave tail section.

These changes in the distribution function and differential distribution function are reflected in the VOD measurements, shown in FIG. 19. The VOD ranged from 2.5 km/s for the 90 mm charge to 3.7 km/s at 180 mm, a significant reduction relative to conventional gassed emulsion described in Example 6. Charges with diameters smaller than 90 mm failed to sustain detonation. The reduced VOD in this example demonstrates the effect of the distribution function and differential distribution function on the shock/heave energy ratio. The shallower slope of this distribution function, the point of inflexion and the concave portion of the differential distribution function result in increased heave energy relative to conventional gassed emulsion, which exhibits a steeply sloped distribution function and convex differential distribution function.

Example 8

MOE 50 at 1.22 g/cm$^3$

This example demonstrates the performance of MOE50, i.e. a mixture of emulsion with 50% mass gassed and 50% ungassed emulsion.

MOE 50 was prepared using the apparatus mentioned in Example 7. The base emulsion (density 1.32 g/cm$^3$) was delivered by two progressive cavity pumps, PC1 and PC2 and was identical to the previous two examples. PC1 pumped ungassed emulsion at a flow rate of 3 kg/min. PC2 delivered emulsion at 3 kg/min with gasser (4% $NaNO_2$ solution) injected by a gasser (gear) pump. The emulsion was blended by a static mixer consisting of three helical mixing elements and loaded into cardboard tubes with internal diameters ranging from 70 to 180 mm. The gassed emulsion target density was 1.13 g/cm$^3$ providing an overall density of 1.22 g/cm$^3$ for the mixture of gassed and ungassed emulsion.

A sample of the emulsion was taken for DF analysis according to the procedure described above. The void positions in this sample are shown in FIG. 23. The cumulative distribution function is plotted in FIG. 26 and the differential plotted in FIG. 27. The MOE50 sample exhibits a distribution function curve with an intermediate slope between conventional gassed emulsion and the MOE 25 described in Examples 6 and 7, respectively. Likewise, the differential distribution function lies between the conventional gassed emulsion and MOE 25, exhibiting a point of inflexion and a slight concave section.

The VOD ranged from 2.8 km/s for the 80 mm charge to 3.9 km/s at 180 mm and is illustrated in FIG. 20. Charges with diameters smaller than 80 mm failed to sustain detonation. VOD results for MOE50 were between those of gassed emulsion and MOE25. This demonstrates that this explosive, with intermediate distribution and differential distribution functions relative to Examples 6 and 7, exhibits an intermediate shock/heave energy ratio. Importantly, the example demonstrates that the present invention allows tailoring of explosive performance (i.e. shock/heave energy balance) to suit different blasting applications by suitable selection of a distribution function template at the same overall explosive density. That is, the invention allows manipulation of the shock/heave energy balance whilst maintaining the same total energy of the explosive.

The DF of an emulsion with a perfectly random distribution of voids, and that of two idealized (simulated) MoEs with the sensitized and unsensitized regions arranged as alternating flat sheets in which no voids have strayed into the unsensitized region, is shown in FIG. 28. The simulated emulsion DF is almost identical to the experimental emulsion. The idealised MoEs however have sharper corner turning in the graphs than the experimental MoEs. The replacement of the sharper corners of the idealized MoE with the smoother concave graphs of the experimental emulsion results from a slightly more diffuse distribution of the voids into the unsensitized regions in the experimental emulsion compared to the simulated MoEs.

Noting the results obtained in the examples, the present invention also provides explosive compositions comprising sensitizing voids distributed in a liquid energetic materials that are believed to be new per se and that exhibit a characteristic distribution function that is different from known void-sensitized explosive formulations, such as emulsions, watergels and slurry formulations. More specifically, for the explosive compositions of the inventions a plot of distribution function rate versus distribution function includes a point of inflexion, and possibly a concave portion. In contrast corresponding plots for conventional explosive formulations exhibit a characteristic domed profile. As explained above, in this context the "distribution function" (or "distance from void" function) is defined as "the fraction of the liquid that is within a given distance from any void surface", and the "distribution function rate" is defined as the differential of the "distribution function" with respect to the distance from any void surface.

In an embodiment, for the explosive compositions a plot of distribution function rate versus distribution function comprises a region extending from a distribution function value of 0% to between 10% and 90%, and wherein after the dome region the "distribution function rate" is between 1% and 50% of the peak of the dome. Preferably, the dome region extends from a "distribution function" value of 0% to between 15% and 85%, and in the region after the dome the "distribution function rate" is between 1.5% and 35% of the peak of the dome. Even more preferably the dome region extends from a "distribution function" value of 0% to between 20% and 80%, and in the region after the dome the "distribution function rate" is between 2% and 20% of the peak of the dome.

The invention claimed is:

1. A method, comprising:

providing a flow of liquid energetic material;

delivering an agent into the flow of liquid energetic material in a series of pulses such that an explosive composition that includes the liquid energetic material and sensitizing voids is produced with the sensitizing voids being present in the liquid energetic material with a non-random distribution, in each pulse, a discrete amount of the agent delivered into the liquid energetic material to produce first regions in the liquid energetic material having sensitizing voids that are sufficiently concentrated to render those regions detonable, between each pulse, no agent being delivered into the liquid energetic material to produce second regions in the liquid energetic material that are not detonable; and delivering the explosive composition into a blasthole.

2. The method of claim 1, wherein the agent is a chemical gassing solution that reacts with one or more components of the liquid energetic material to generate gas bubbles that are the sensitizing voids.

3. The method of claim 2, wherein a distribution of gas bubbles in the liquid energetic material is manipulated by controlling one or more of: (i) the flow rate of the liquid energetic material at the location of delivery of the chemical gassing solution during each pulse, (ii) an amount of the chemical gassing solution, (iii) a type of the chemical gassing solution, (iv) a concentration of the chemical gassing solution, (v) a duration of each pulse, or (vi) a frequency of pulses.

4. The method of claim 1, wherein the agent is at least one of glass micro-balloons, plastic micro-balloons, or expanded polystyrene beads.

5. The method of claim 4, wherein a distribution of sensitizing voids is manipulated by controlling one or more of: (i) a flow rate of the liquid energetic material at a location at which the agent is delivered into the liquid energetic material, (ii) a flow rate of the agent, (iii) a type agent, (iv) a duration of each pulse, or (v) a frequency of pulses.

6. The method of claim 1, further comprising detonating the explosive composition.

7. A mobile manufacturing and delivery platform that is adapted to provide in a blasthole, an explosive composition in accordance with the method of claim 1, the mobile manufacturing and delivery platform comprising:

a storage tank for a liquid energetic material;

a delivery line for conveying a stream of the liquid energetic material from the storage tank;

a void delivery system for delivering an agent into the stream of liquid energetic material in a series of pulses such that an explosive composition that includes the liquid energetic material and sensitizing voids is produced with the sensitizing voids being present in the liquid energetic material with a non-random distribution, in each pulse, a discrete amount of the agent delivered into the liquid energetic material to produce first regions in the liquid energetic material having sensitizing voids that are sufficiently concentrated to render those regions detonable, between each pulse, no agent being delivered into the liquid energetic material to produce second regions in the liquid energetic material that are not detonable; and a blasthole loading hose.

8. The mobile manufacturing and delivery platform of claim 7, wherein the void delivery system comprises a flow control valve or a reciprocating pump.

9. The mobile manufacturing and delivery platform of claim 7, wherein the storage tank comprises at least two independent compartments and a valve for controlling which compartment feeds the delivery line.

10. The mobile manufacturing and delivery platform of claim 7, wherein the storage tank comprises at least two independent compartments, a supply line extending from each compartment and a valve for controlling which supply line feeds the delivery line.

11. A method of blasting in which an explosive composition is provided in a blasthole using a mobile manufacturing and delivery platform as claimed in claim 7.

12. A method of blasting in which an explosive composition is provided in a blasthole using a mobile manufacturing and delivery platform as claimed in claim 7, and the explosive composition subsequently detonated.

13. A portable module that is adapted to provide in a blasthole an explosive composition in accordance with the method of claim 1, the portable module comprising:

a delivery line for conveying a stream of the liquid energetic material from a storage tank;

a void delivery system for delivering an agent into the stream of liquid energetic material in a series of pulses such that an explosive composition that includes the liquid energetic material and sensitizing voids is produced with the sensitizing voids being present in the liquid energetic material with a non-random distribution, in each pulse, a discrete amount of the agent delivered into the liquid energetic material to produce first regions in the liquid energetic material having sensitizing voids that are sufficiently concentrated to render those regions detonable, between each pulse, no agent being delivered into the liquid energetic material to produce second regions in the liquid energetic material that are not detonable; and a blasthole loading hose.

14. The portable module of claim 13, wherein the void delivery system comprises a flow control valve or a reciprocating pump.

15. A method of blasting in which an explosive composition is provided in a blasthole using a mobile manufacturing and delivery platform as claimed in a portable module as claimed in claim 13, and the explosive composition subsequently detonated.

16. A method of blasting in which an explosive composition is provided in a blasthole using a portable module as claimed in claim 13.

17. The method of claim 1, wherein, prior to the delivery of sensitizing voids, the liquid energetic material is not void sensitized.

18. The method of claim 1, wherein the agent is delivered into a liquid energetic material that is already void sensitized.

19. The method of claim 1, wherein the explosive composition has a uniform internal structure in a given volume, with that uniform internal structure being varied between volumes within an overall volume of the explosive composition produced.

* * * * *